US007086714B2

(12) United States Patent
Endo

(10) Patent No.: US 7,086,714 B2
(45) Date of Patent: Aug. 8, 2006

(54) METHOD FOR FINDING RECORDING-START POSITION

(75) Inventor: Hironori Endo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 247 days.

(21) Appl. No.: 10/676,251

(22) Filed: Oct. 2, 2003

(65) Prior Publication Data

US 2004/0223022 A1 Nov. 11, 2004

(30) Foreign Application Priority Data

Oct. 2, 2002 (JP) ..... 2002-289818

(51) Int. Cl.
*B41J 29/38* (2006.01)
*B41J 2/01* (2006.01)
*B41J 13/26* (2006.01)
*B65H 7/02* (2006.01)

(52) U.S. Cl. ..... 347/16; 347/101; 347/104; 271/227; 400/633

(58) Field of Classification Search ..... 347/101, 347/104, 106, 14, 23, 19, 4, 5, 6, 16; 400/709, 400/579
See application file for complete search history.

(56) References Cited

U.S. PATENT DOCUMENTS 5,192,141 A * 3/1993 Chung et al. ..... 400/56
5,273,274 A * 12/1993 Thomson et al. ..... 271/228
5,466,079 A * 11/1995 Quintana ..... 400/579
5,564,848 A * 10/1996 Quintana ..... 400/708
5,732,943 A * 3/1998 Delfosse ..... 271/228
6,092,893 A * 7/2000 Yokoi et al. ..... 347/104
6,305,856 B1 * 10/2001 Miyazaki ..... 400/279
6,352,332 B1 * 3/2002 Walker ..... 347/19
6,447,089 B1 * 9/2002 Arquilevich et al. ..... 347/16
6,527,360 B1 * 3/2003 Otsuki et al. ..... 347/19
6,588,872 B1 * 7/2003 Anderson et al. ..... 347/19
6,747,429 B1 * 6/2004 Igarashi ..... 318/560
6,840,691 B1 * 1/2005 Isono et al. ..... 400/579
6,846,058 B1 * 1/2005 Claramunt et al. ..... 347/16

FOREIGN PATENT DOCUMENTS

JP 5-138999 A 6/1993
JP 7-285248 A 10/1995

* cited by examiner

*Primary Examiner*—K. Feggins
*Assistant Examiner*—Shelby Fidler
(74) *Attorney, Agent, or Firm*—Sughrue Mion, PLLC

(57) ABSTRACT

A recording start position is obtained effectively with high precision and in a short time. A recording method for recording on a recording medium, includes the steps of: positioning a sensor in a one edge side in a movement direction of the sensor; carrying the recording medium in a predetermined direction up to a detection position where the sensor detects the recording medium; after bringing the sensor in a state in which the sensor does not detect the recording medium, moving the sensor toward another edge side opposite to the one edge side until the sensor detects the recording medium; and if the sensor detects the recording medium: obtaining a leading distance by which an upper edge of the other edge side, being one of an upper right edge and an upper left edge of the recording medium, leads an upper edge of the one edge side based on a carrying distance of the recording medium that is necessary for the sensor that has been brought into the state in which the sensor does not detect the recording medium to again detect the upper edge of the recording medium at the one edge side and a movement distance of when the sensor has moved from the one edge side to a position at which the sensor detects the recording medium; and carrying the recording medium by an amount that corresponds to the leading distance.

30 Claims, 14 Drawing Sheets

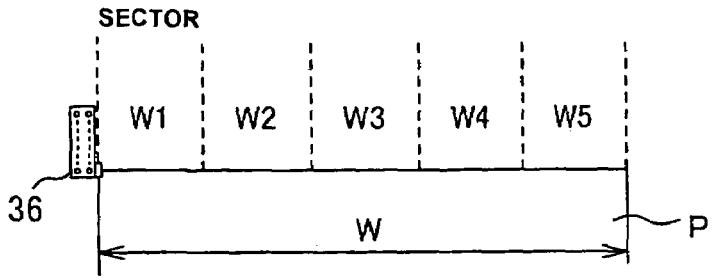
FIG. 16A
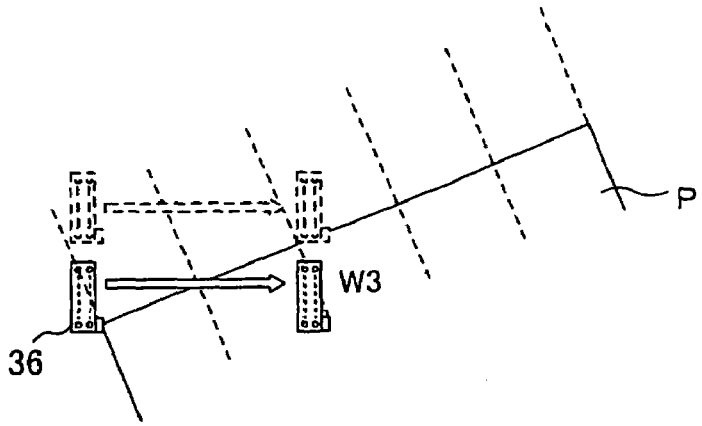
FIG. 16B
| SECTOR | CARRYING DISTANCE |
|---|---|
| W1 | L1 |
| W2 | L2 |
| W3 | L3 |
| W4 | L4 |
| W5 | 0 |
FIG. 17

METHOD FOR FINDING RECORDING-START POSITION

CROSS-REFERENCE TO RELATED APPLICATION

The present application claims priority upon Japanese Patent Application No. 2002-289818 filed on Oct. 2, 2002, which is herein incorporated by reference.

BACKGROUND OF THE INVENTION

1. Field of the Invention

The present invention relates to recording methods, recording apparatuses, and computer-readable storage media.

2. Description of the Related Art

Inkjet printers that intermittently eject a liquid to perform recording are known as an example of recording apparatuses that eject a liquid onto various types of recording media, such as paper, cloth, and film, in order to record images. With such inkjet printers, images are recorded by alternately repeating a step of positioning the recording medium after carrying it in a direction toward a recording head, and a step of ejecting liquid while moving the recording head in a main scanning direction that intersects the direction in which the recording medium is carried.

However, when the recording medium is carried in a direction toward the recording head, if it is carried while either its right upper edge or left upper edge leads the other edge, that is, if the recording medium is carried skewed in the carrying direction, then the actual recording position on the recording medium will be displaced from the intended recording position, and the quality of the recorded image may be affected. In particular, when performing borderless recording, a skew in the recording medium in the carrying direction can cause blank areas on the upper edge of the recording medium, and this alone may make the recording medium unusable. On the other hand, when performing borderless recording, although enlarging the margin of the recording area with respect to the recording medium lessens the likelihood of blank areas appearing on the upper edge of the recording medium, there is a possibility that the amount of liquid that is consumed will increase.

SUMMARY OF THE INVENTION

The present invention was arrived at in light of the foregoing issues, and it is an object thereof to achieve a recording method, a recording apparatus, and a computer-readable medium capable of obtaining a recording start position for a recording medium with high precision and in a short time.

Features and objects of the present invention other than the above will be made clear by the description of the present specification with reference to the accompanying drawings.

BRIEF DESCRIPTION OF THE DRAWINGS

In order to facilitate further understanding of the present invention and the advantages thereof, reference is now made to the following description taken in conjunction with the accompanying drawings wherein:

FIG. 16A is a drawing showing a width W of the print paper P divided into five sectors W1, W2, W3, W4, and W5;

FIG. 16B is a drawing showing the reflective optical sensor 29 detecting the upper edge of the print paper P in the sector W3 while moving from the one edge side to the other edge at a time when the electric signal measuring section 66 of the reflective optical sensor control circuit 65 is not outputting the logic value "L"; and FIG. 17 is a data table where a plurality of sectors correspond to a plurality of carrying distances.

DETAILED DESCRIPTION OF THE INVENTION

Figure 1:
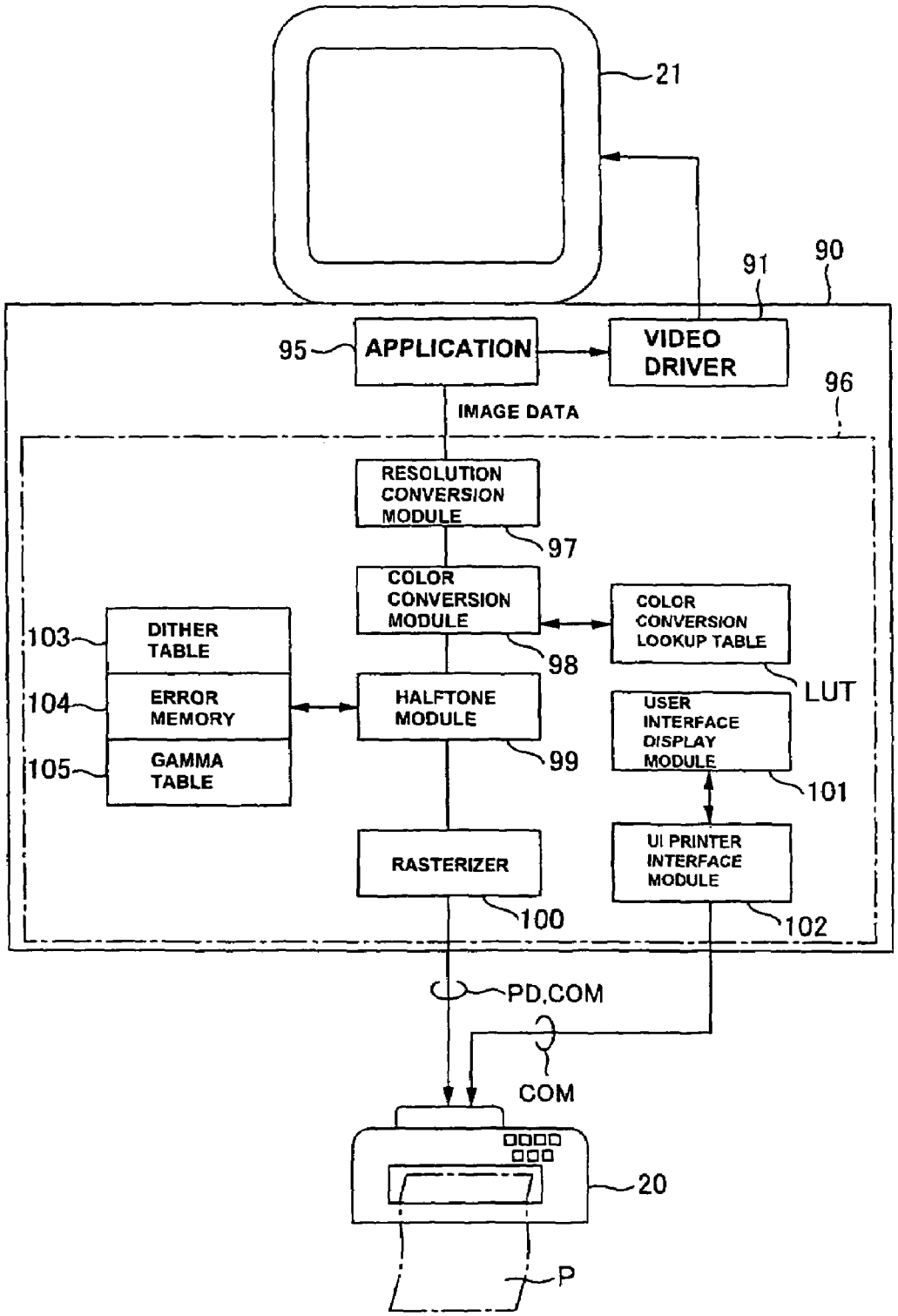
FIG. 1 is a block diagram showing an example configuration of a computer system provided with a recording apparatus of the present invention.

At least the following matters will be made clear by the present specification and the accompanying drawings.

A recording method for recording on a recording medium, comprises the steps of:

positioning a sensor in a one edge side in a movement direction of the sensor;

carrying the recording medium in a predetermined direction up to a detection position where the sensor detects the recording medium;

after bringing the sensor in a state in which the sensor does not detect the recording medium, moving the sensor toward another edge side opposite to the one edge side until the sensor detects the recording medium; and if the sensor detects the recording medium:

obtaining a leading distance by which an upper edge of the other edge side, being one of an upper right edge and an upper left edge of the recording medium, leads an upper edge of the one edge side based on a carrying distance of the recording medium that is necessary for the sensor that has been brought into the state in which the sensor does not detect the recording medium to again detect the upper edge of the recording medium at the one edge side and a movement distance of when the sensor has moved from the one edge side to a position at which the sensor detects the recording medium; and carrying the recording medium by an amount that corresponds to the leading distance.

According to this recording method, after the sensor detects an upper edge of the carried recording medium, if the sensor that once entered a state in which it does not detect the recording medium again detects the recording medium in the process of moving from one edge side to the other edge side, then based on the carrying distance of the recording medium that is necessary for the sensor that once entered a state in which it does not detect the recording medium to again detect the upper edge of the recording medium at the one edge side and the movement distance for when the sensor moves from the one edge side until the position in which it detects the recording medium, the distance by which the upper edge of the other edge side of the recording medium leads the upper edge of the one edge side is obtained, and the recording medium is carried by an amount in accordance with the leading distance. In this way, it becomes possible to effectively obtain the recording start position for the recording medium with high precision and in a short time. For example, it becomes possible to solve the issues of blank spaces being formed on the upper edge of the recording medium, and of the amount of liquid consumed increasing when performing borderless printing.

Furthermore, in the present recording method, the sensor may be brought into the state in which the sensor does not detect the recording medium by lowering a detection sensitivity of the sensor.

According to this recording method, it becomes possible to effectively obtain a recording start position for a recording medium with high precision and in a short time by using a sensor in which the detection sensitivity of the sensor is lowered to bring the sensor into a state in which it does not detect the recording medium.

Furthermore, in the present recording method, the sensor may be brought into the state in which the sensor does not detect the recording medium by carrying the recording medium by a predetermined amount from the detection position in a direction opposite to the predetermined direction.

According to this recording method, it becomes possible to effectively obtain a recording start position for a recording medium with high precision and in a short time by using a sensor where, by carrying the recording medium by a predetermined amount from the detection position in an opposite direction to the predetermined direction, the sensor goes into a state in which the recording medium is not detected.

Furthermore, in the present recording method, if the sensor that has been brought into the state in which the sensor does not detect the recording medium did not detect the recording medium while moving from the one edge side to the other edge side, then the recording medium may be carried from the detection position by a predetermined amount in the predetermined direction.

According to this recording method, while the sensor moves from the one edge side to the other edge side in a state in which it does not detect the recording medium, if the recording medium is not detected, it is determined that the one edge side of the recording medium is leading the other edge side, or that the other edge side of the recording medium is leading the one edge side by less than a predetermined amount, and the recording medium is carried. In this way, it becomes possible to effectively obtain the recording start position for a recording medium with high precision and in a short time when either the one edge side or the other edge side of the recording medium leads the other.

Furthermore, in the present recording method, if the sensor that has been brought into the state in which the sensor does not detect the recording medium detects the recording medium while moving from the one edge side to the other edge side, then:

a skew angle of the recording medium in a direction intersecting the movement direction of the sensor may be obtained based on the carrying distance of the recording medium that is necessary for the sensor that has been brought into the state in which the sensor does not detect the recording medium to again detect the upper edge of the recording medium at the one edge side and the movement distance of when the sensor has moved from the one edge side to the position at which the sensor detects the recording medium; and the leading distance by which the upper edge of the other edge side, being one of the upper right edge and the upper left edge of the recording medium, leads the upper edge of the one edge side may be obtained based on the skew angle and a width of the recording medium.

According to this recording method, a skew angle at which the recording medium intersects a movement direction of the sensor is obtained, and a distance by which an upper edge of the other edge side of the recording medium leads an upper edge of the one edge side is obtained based on the skew angle and a width of the recording medium. In this way it becomes possible to effectively obtain a recording start position for a recording medium with high precision and in a short time.

Furthermore, in the present recording method, the sensor may move in the movement direction together with a recording head.

According to this recording method, it becomes possible to effectively obtain a recording start position for a recording medium with high precision and in a short time by using a sensor that moves in the movement direction with a recording head.

Furthermore, in the present recording method, the sensor may comprise a light-emitting member for emitting light and a light-receiving member for receiving light emitted by the light-emitting member, and detects the recording medium based on an output value of the light-receiving member.

According to this recording method, it becomes possible to effectively obtain a recording start position for a recording medium with high precision and in a short time by using a sensor that includes a light-emitting member for emitting light, and a light-receiving member for receiving light emitted by the light-emitting member, and detects the recording medium based on an output value of the light-receiving member.

Furthermore, in the present recording method, the recording head may carry out recording with respect to an entire surface of the recording medium.

According to this recording method, it becomes possible to effectively obtain a recording start position for a recording medium with high precision and in a short time by using a recording head that carries out recording on an entire front surface of the recording medium.

Furthermore, a recording method for recording on a recording medium, comprises the steps of:

dividing a movement direction of a sensor into a plurality of sectors and positioning the sensor in a one edge side in the movement direction;

carrying the recording medium in a predetermined direction up to a detection position where the sensor detects the recording medium;

after bringing the sensor in a state in which the sensor does not detect the recording medium, moving the sensor toward another edge side opposite to the one edge side until the sensor detects the recording medium; and if the sensor detects the recording medium:

obtaining a leading distance by which an upper edge of the other edge side, being one of an upper right edge and an upper left edge of the recording medium, leads an upper edge of the one edge side according to which sector, in the movement direction, the sensor detected the recording medium in; and carrying the recording medium by an amount that corresponds to the leading distance.

According to this recording method, after the sensor has detected the upper edge of the carried recording medium, the distance by which the upper edge of the other edge side of the recording medium leads the upper edge of the one edge side is obtained in accordance to which sector in the movement direction of the sensor the recording medium is detected when the sensor, which has been brought into a state in which it does not detect the recording medium, detects the recording medium in the process of moving from the one edge side to the other edge side, and the recording medium is caused to be carried by an amount in accordance to this leading distance. In this way, it becomes possible to effectively obtain the recording start position for the recording medium in a short time. In particular, by finely subdividing the sectors in the movement direction of the sensor, it becomes possible to obtain the recording start position for the recording medium with high precision.

Furthermore, in the present recording method, the sensor may be brought into the state in which the sensor does not detect the recording medium by lowering a detection sensitivity of the sensor.

According to this recording method, it becomes possible to effectively obtain a recording start position for a recording medium with high precision and in a short time by using a sensor whose detection sensitivity is lowered so that the sensor goes into a state in which the recording medium is not detected.

Furthermore, in the present recording method, the sensor may be brought into the state in which the sensor does not detect the recording medium by carrying the recording medium by a predetermined amount from the detection position in a direction opposite to the predetermined direction.

According to this recording method, it becomes possible to effectively obtain a recording start position for a recording medium with high precision and in a short time by using a sensor in which, by carrying the recording medium by a predetermined amount from the detection position in an opposite direction to the predetermined direction, the sensor goes into a state in which the recording medium is not detected.

Furthermore, in the present recording method, if the sensor that has been brought into the state in which the sensor does not detect the recording medium did not detect the recording medium while moving from the one edge side to the other edge side, then the recording medium may be carried from the detection position by a predetermined amount in the predetermined direction.

According to this recording method, when the sensor, in a state in which the recording medium is not detected, does not detect the recording medium while moving from the one edge side to the other edge side, it is determined that the one edge side of the recording medium is leading the other edge side, or that the other edge side of the recording medium is leading the one edge side by less than the predetermined amount. In this way it becomes possible to effectively obtain a recording start position for a recording medium with high precision and in a short time no matter which of the one edge side or the other edge side of the recording medium is leading.

Furthermore, in the present recording method, the sensor may move in the movement direction together with a recording head.

According to this recording method, it becomes possible to effectively obtain a recording start position for a recording medium with high precision and in a short time by using a sensor that moves in the movement direction with a recording head.

Furthermore, in the present recording method, the sensor may comprise a light-emitting member for emitting light and a light-receiving member for receiving light emitted by the light-emitting member, and detects the recording medium based on an output value of the light-receiving member.

According to this recording method, it becomes possible to effectively obtain a recording start position for a recording medium with high precision and in a short time by using a sensor that includes a light-emitting member for emitting light and a light-receiving member for receiving light emitted by the light-emitting member, and detects the recording medium based on an output value of the light-receiving member.

Furthermore, in the present recording method, the recording head may carry out recording with respect to an entire surface of the recording medium.

According to this recording method, it becomes possible to effectively obtain a recording start position for a recording medium with high precision and in a short time by using a recording head that carries out recording on an entire front surface of the recording medium.

Furthermore, recording apparatuses and computer-readable media allowing for the above-described methods to be achieved can also be realized.

===Example Configuration of Computer System===

FIG. 1 is a block diagram showing an example configuration of a computer system provided with a recording apparatus of the present invention. The computer system in FIG. 1 is constructed of a color inkjet printer 20, a computer 90, a display device (a CRT 21 or an unshown liquid crystal display, for example), an input device (an unshown keyboard or mouse, for example), and a drive device (an unshown flexible drive device or CD-ROM drive, for example). It should be noted that in this embodiment the recording apparatus is constructed of the color inkjet printer 20, and a printer driver 96 inside the computer 90. In this case, the recording apparatus may be configured so that the printer driver 96 is incorporated in the color inkjet printer 20. Furthermore, the color inkjet printer 20 may serve as the recording apparatus.

The computer 90 is provided with a video driver 91 for driving the CRT 21 so that is performs displaying, the printer driver 96 for driving the color inkjet printer 20 so that it prints, and an application program 95 for controlling and driving the video driver 91 and the printer driver 96. The video driver 91 appropriately processes image data to be processed in accordance with display orders from the application program 95, and then supplies the data to the CRT 21. The CRT 21 displays an image that corresponds to the image data supplied from the video driver 91. Furthermore, in accordance with print orders from the application program 95, the printer driver 96 appropriately processes the image data to be processed, and then supplies them to the color inkjet printer 20 as print data PD. The operation of the video driver 91, the printer driver 96, and the application program 95 are controlled by an operating system OS (not shown) that is installed in the computer 90 in advance.

<Example Configuration of Printer Driver 96>

The printer driver 96 is provided with a resolution conversion module 97, a color conversion module 98, a halftone module 99, a dither table 103, an error memory 104, a gamma table 105, a rasterizer 100, a user interface display module 101, a UI printer interface module 102, and a color conversion lookup table LUT.

Image data (character data in an outline font, illustration data, etc.) that is specified by a user and output from the application program 95 is converted to color image data of a resolution for printing to a print paper P by the resolution conversion module 97. It should be noted that the color image data converted by the resolution conversion module 97 are RGB color data made of color components of the three primary colors of RGB.

The color conversion lookup table LUT is for determining a conversion relationship between the RBG color data output from the resolution conversion module 97 and CMYK color data. The color conversion module 98 references the color conversion lookup table LUT and for each pixel converts the RGB color image data that is output from the resolution conversion module 97 into multi-gradation data of a plurality of ink colors that can be used by the color inkjet printer 20. It should be noted that the multi-gradation data that have been converted by the color conversion module 98 have a gradation value of 256 levels, for example.

The halftone module 99 references the dither table 103 to perform dithering and the gamma table 105 to perform γ correction, and uses the error memory 104 to store diffused error when performing error diffusion. In this way, the halftone module performs halftone processing on multi-gradation data that is output from the color conversion module 98, and generates halftone image data as pixel data. It should be noted that the CMYK halftone image data is binary data in which, for each pixel unit, a dot that is to be displayed takes the logic value "1," and a dot that is not to be displayed takes the logic value "0."

The rasterizer 100 arranges the binary halftone image data obtained from the halftone module 99 into a data sequence to be supplied to the color inkjet printer 20, and supplies this to the color inkjet printer 20 as the print data PD. It should be noted that the print data PD includes raster data that indicates the manner in which dots are formed when the print head moves in the main scanning direction, and data that indicates the carry amount that the print medium is successively moved in the sub-scanning direction which intersects the main scanning direction.

The user interface display module 101 has a function for displaying various windows related to printing, and a function for receiving instructions input by the user into these windows.

The UI printer interface module 102 is interposed between the user interface display module 101 and the color inkjet printer 20 to provide a bi-directional interface. That is, when a user enters instructions to the user interface display module 101, the UI printer interface module 102 serves as an interface in the direction in which various commands COM obtained by decoding orders from the user interface display module 101 are supplied to the color inkjet printer 20. On the other hand, the UI printer interface module 102 also serves as an interface in the direction in which various commands COM from the color inkjet printer 20 are supplied to the user interface display module 101.

In this way, the printer driver 96 achieves a function for supplying print data PD to the color inkjet printer 20, and a function for inputting and outputting the various commands COM between itself and the color inkjet printer 20. It should be noted that, as a computer-readable storage medium, a program for achieving the functions of the printer driver 96 is supplied to the computer 90 in a recorded state on various media such as flexible disks, CD-ROMs, magneto optical disks, IC cards, ROM cartridges, punch cards, printed materials on which a code is printed such as barcodes, and internal storage devices and external storage devices of the computer. Furthermore, the program for achieving the functions of the printer driver 96 can be downloaded to the computer 90 from a WWW (World Wide Web) server or the like publicly available on the Internet.

===Example Configuration of Recording Apparatus (Inkjet Printer)===

Figure 2:
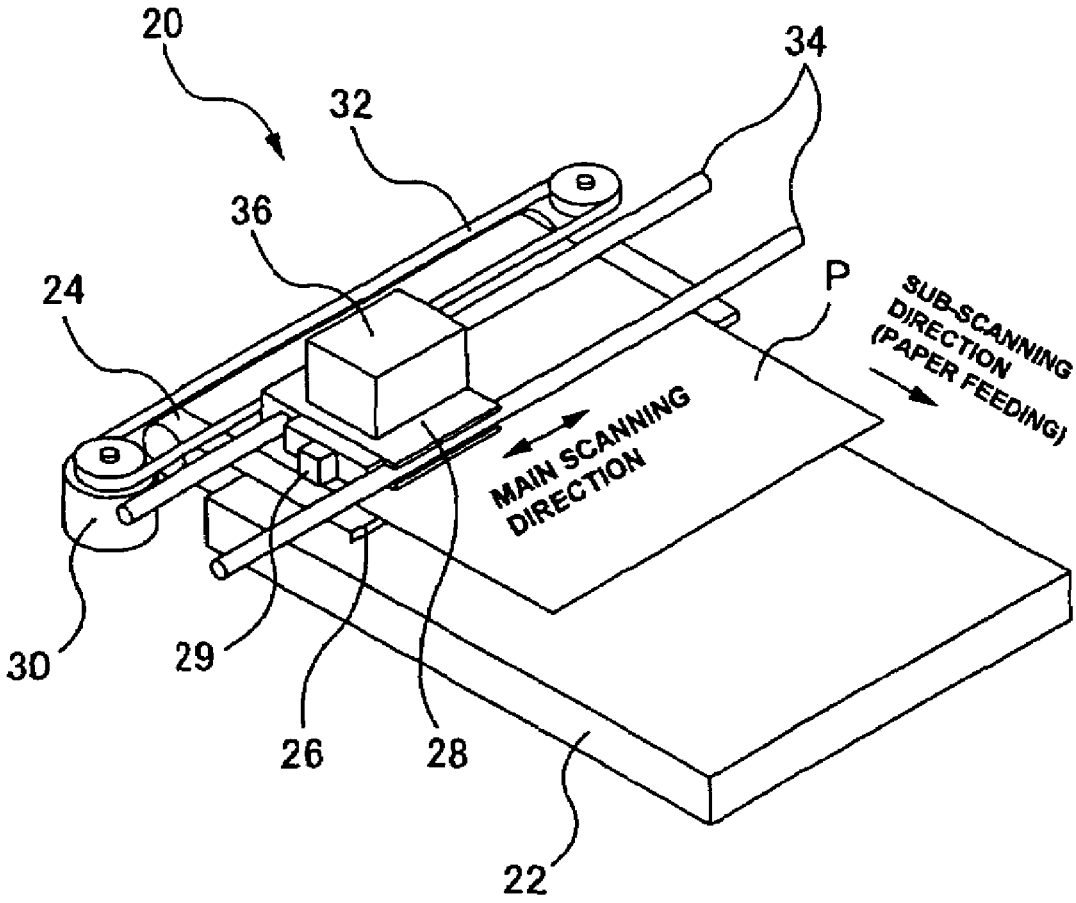
FIG. 2 is an overall perspective view showing an example of a principal configuration of a color inkjet printer 20 shown in FIG. 1.

FIG. 2 is an overall perspective view showing an example of a principal configuration of the color inkjet printer 20 shown in FIG. 1. The color inkjet printer 20 is provided with a paper stacker 22, a paper feed roller 24 driven by a PF motor 31 (see FIG. 4), a platen 26, a carriage 28 that serves as a moving member, a carriage motor 30, a pull belt 32 for conveying the drive power of the carriage motor 30, and guide rails 34 for guiding the carriage 28. Also, the carriage 28 is provided with a print head 36 that has a plurality of nozzles for forming dots, and a reflective optical sensor 29 that serves as a light-emitting member and a light-receiving member that will be discussed later.

The carriage 28 is pulled by the pull belt 32, which conveys the drive power of the carriage motor 30, and moves in the main scanning direction shown in FIG. 2 along the guide rails 34. The print paper P is drawn out from the paper stacker 22, wound onto the paper feed roller 24, and then carried onto the surface of the platen 26 in a vertical sub-scanning direction that intersects the main scanning direction shown in FIG. 2. It should be noted that the paper feed roller 24 is driven by the PF motor 31 (see FIG. 4) when the operation of supplying the print paper P from the paper stacker 22 onto the platen 26 and the operation of discharging the print paper P from the platen 26 are performed, and is positioned as a carrying mechanism for carrying the print paper P.

===Example Configuration of Sensor (Detection Means)===

Figure 3:
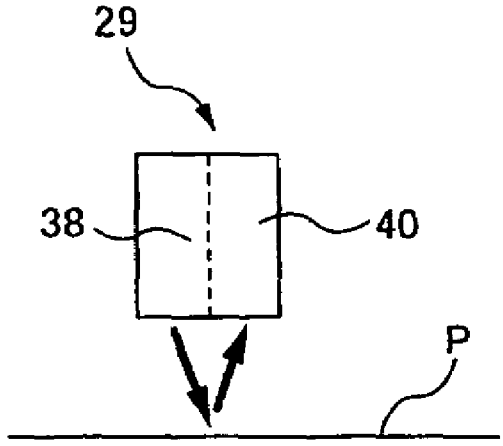
FIG. 3 is a schematic diagram for describing an example of the reflective optical sensor 29 provided at the carriage 28.

FIG. 3 is a schematic diagram for describing an example of the reflective optical sensor 29, which serves as a sensor (detection means) provided at the carriage 28. The reflective optical sensor 29 has a light-emitting member 38 such as a light-emitting diode that emits light, and a light-receiving member 40 such as a phototransistor that receives light emitted by the light-emitting member, and although it is for detecting the width of the print paper P in the main scanning direction and the upper edge of the print paper P in the sub-scanning direction, it is also possible to provide separate reflective optical sensors for detecting these. It should be noted that the light-emitting member 38 is not limited to the above-mentioned light-emitting diode, and as long as the member is capable of constituting a component for realizing the present invention by emitting light, any such member may be employed. Also, the light-receiving member 40 is not limited to the above-mentioned phototransistor, and as long as the member is capable of constituting a component for achieving the present invention by receiving light from the light-emitting member 38, any such member may be employed.

The incident light with directivity that is emitted by the light-emitting member 38 is irradiated onto the print paper P if there is print paper P in the incident direction. On the other hand, if there is no print paper P in the incident direction, then the light is irradiated onto the platen 26. The incident light that is emitted onto the print paper P or the platen 26 is reflected. The light that is reflected at this time is received by the light-receiving member 40 and is converted into an electric signal that serves as an output value corresponding to the intensity of the reflected light. In other words, the intensity of the light reflected by the print paper P and the platen 26 is different, and thus whether or not there is print paper P in the incident direction of the reflective optical sensor 29 can be determined according to the size of the electric signal obtained from the light-receiving member 40. The size of the electric signal obtained from the light-receiving member 40 is measured by an electric signal measuring section 66 that will be described later.

It should be noted that in this embodiment, the reflective optical sensor 29 is provided as a single unit incorporating the light-emitting member 38 and the light-receiving member 40, but the present invention is not limited to this. In other words, the reflective optical sensor 29 may be configured with the light-emitting member 38 and the light-receiving member 40 serving as separate members, and the reflective optical sensor 29 may be configured to be provided on the carriage 28.

Furthermore, in this embodiment, an electric signal that corresponds to the intensity of the reflected light obtained by the light-receiving member 40 is measured, but this is not a limitation. That is, a means may be provided that is capable of measuring the intensity of the reflected light received by the light-receiving member 40 in a form other than an electric signal.

Figure 8:
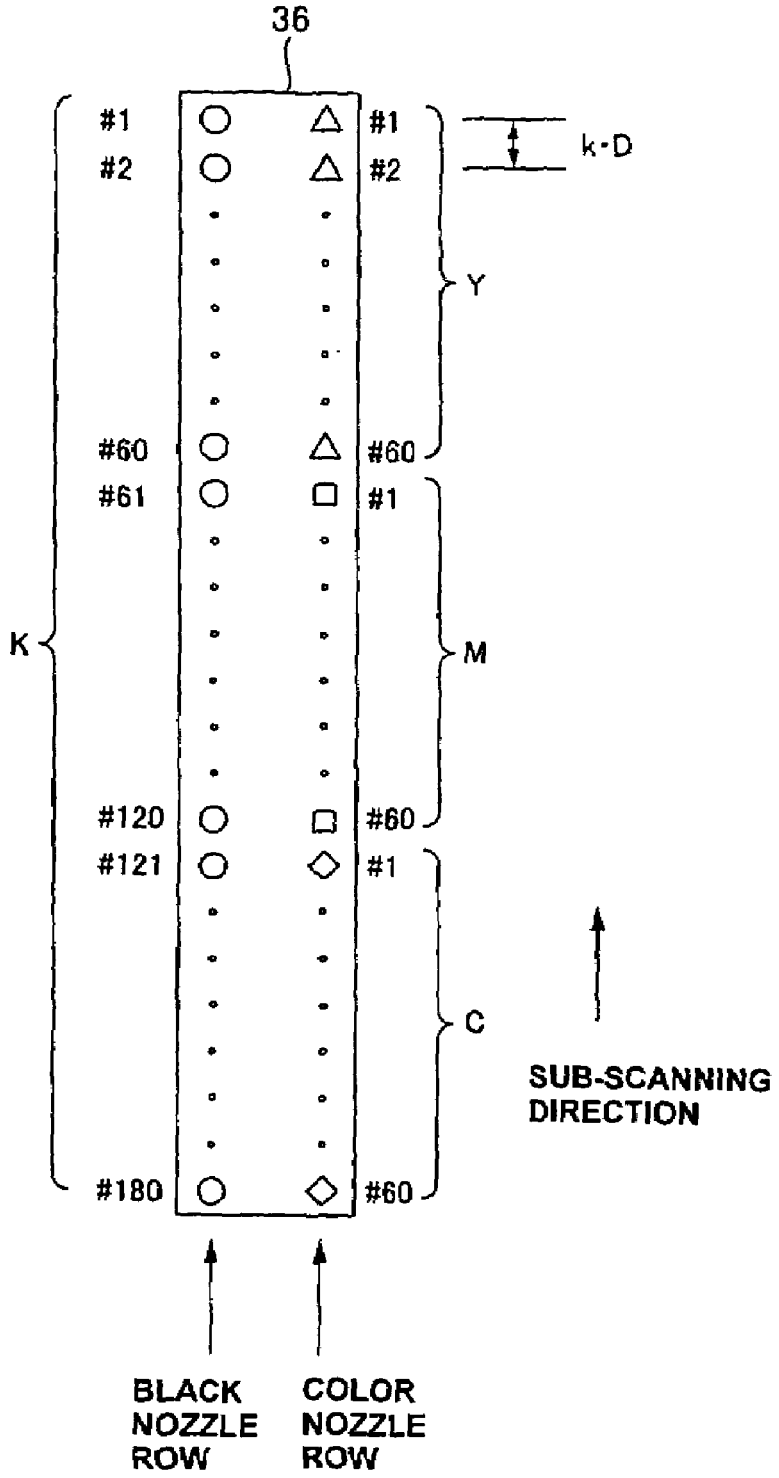
FIG. 8 is an explanatory diagram showing a nozzle arrangement on a bottom surface of a print head 36.

The reflective optical sensor 29 is provided at the carriage 28 in a position on the upstream side when the print paper P is carried in the sub-scanning direction. For example, as can be seen in FIG. 8, the reflective optical sensor 29 may be provided to the left side on the page of the black nozzle #180 of the print head 36.

===Example Configuration of Carriage Area ===

Figure 4:
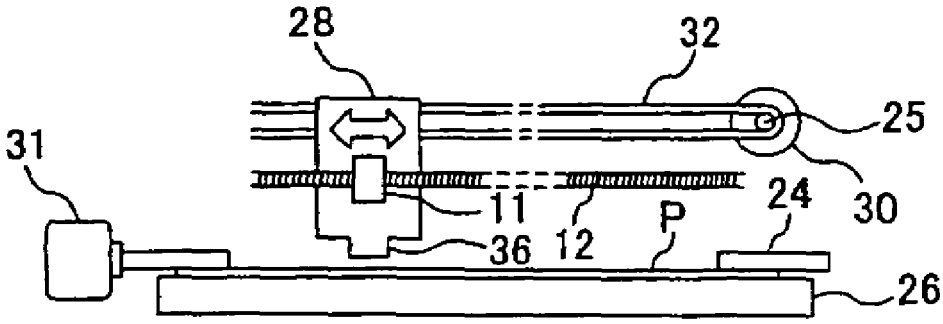
FIG. 4 is a diagram showing an example configuration of the carriage 28 area of the color inkjet printer 20.

FIG. 4 is a diagram showing an example configuration of the carriage 28 area of the color inkjet printer 20. The color inkjet printer 20 is provided with a paper feed motor (hereafter "PF motor") 31 for carrying the print paper P, the carriage 28 on which the print head 36 for ejecting ink onto the print paper P is provided and which moves in the main-scanning direction, the carriage motor (hereafter "CR motor") 30 for driving the carriage 28, a linear encoder 11 that is provided on the carriage 28, a linear scale 12 in which slits are formed at a predetermined spacing, the platen 26 for supporting the print paper P, the paper feed roller 24 for carrying the print paper P in the sub-scanning direction due to the drive power conveyed from the PF motor 31, a rotary encoder 13 (see FIG. 7) for detecting the amount of rotation of the paper feed roller 24, a pulley 25 arranged at the rotational shaft of the CR motor 30, and the pull belt 32 linked by the pulley 25.

===Example Configuration of Encoder ===

Figure 5:
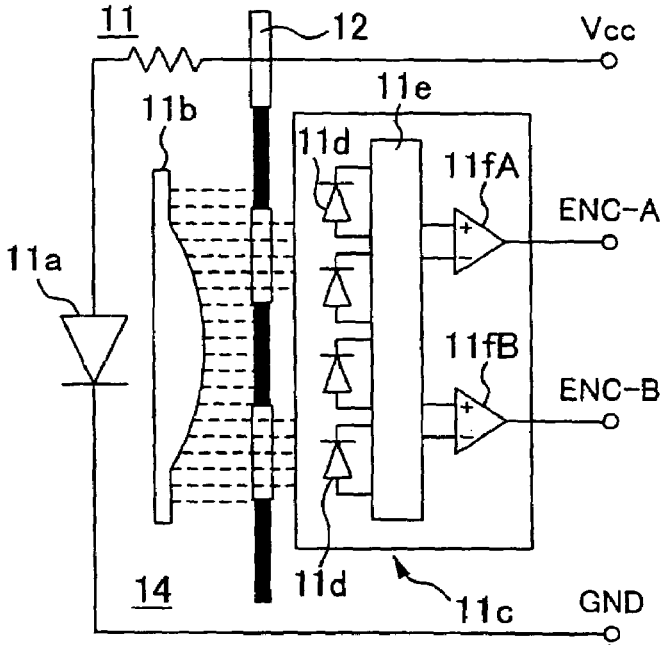
FIG. 5 is an explanatory diagram of the linear encoder 11.

FIG. 5 is an explanatory diagram of the linear encoder 11.

The linear encoder 11 is for detecting the position of the carriage 28, and has the linear scale 12 and a detection section 14.

The linear scale 12 is provided with slits at a predetermined spacing (for example, every 1/180 inch (1 inch equals 2.54 cm)), and is fastened to the main printer unit. The detection section 14 is provided in opposition to the linear scale 12, and is on the carriage 28 side. The detection section 14 has a light-emitting diode 11*a*, a collimating lens 11*b*, and a detection processing section 11*c*. The detection processing section 11*c* is provided with a plurality of (for instance, four) photodiodes 11*d*, a signal processing circuit 11*e*, and two comparators 11*f*A and 11*f*B.

The light-emitting diode 11*a* emits light when a voltage Vcc is applied to it via a resistor on the anode side, and this light is incident on the collimating lens 11*b*. The collimating lens 11*b* turns the light that is emitted from the light-emitting diode 11*a* into parallel light, and irradiates the parallel light on the linear scale 12. The parallel light that passes through the slits provided in the linear scale 12 then passes through stationary slits (not shown) and is incident on the photodiodes 11*d*. The photodiodes 11*d* convert the incident light into electric signals. The electric signals that are output from the photodiodes 1*d* are compared in the comparators 11*f*A and 11*f*B, and the results of these comparisons are output as pulses. Then, the pulse ENC-A and the pulse ENC-B that are output from the comparators 11*f*A and 11*f*B become the output of the linear encoder 11.

Figure 6A:
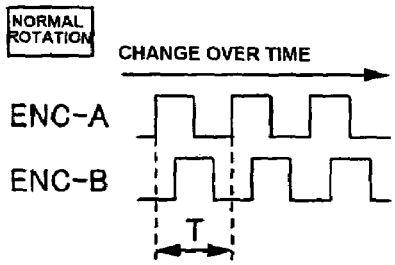
FIG. 6A is a timing chart of the waveforms of the output signals when the CR motor 30 is rotating forward.
Figure 6B:
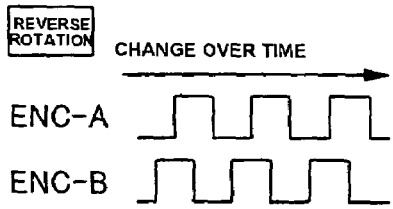
FIG. 6B is a timing chart of the waveforms of the output signals when the CR motor 30 is rotating in reverse.

FIG. 6A is a timing chart of the waveforms of the output signals when the CR motor 30 is rotating forward. FIG. 6B is a timing chart of the waveforms of the output signals when the CR motor 30 is rotating in reverse.

As shown in FIG. 6A and FIG. 6B, the phases of the pulse ENC-A and the pulse ENC-B are misaligned by 90 degrees both when the CR motor 30 is rotating forward and when it is rotating in reverse. When the CR motor 30 is rotating forward, that is, when the carriage 28 is moving in the main-scanning direction, then, as shown in FIG. 6A, the phase of the pulse ENC-A leads the phase of the pulse ENC-B by 90 degrees. On the other hand, when the CR motor 30 is rotating in reverse, then, as shown in FIG. 6B, the phase of the pulse ENC-A trails the pulse ENC-B by 90 degrees. A single period T of each of these pulses is equivalent to the time during which the carriage 28 is moved by the slit spacing (for example, by 1/180 inch (1 inch equals 2.54 cm)) of the linear scale 12.

The position of the carriage 28 is detected as follows. First, the rising edge or the falling edge of either the pulse ENC-A or ENC-B is detected, and the number of detected edges is counted. The position of the carriage 28 is calculated based on the counted number. With respect to the counted number, when the CR motor 30 is rotating forward a "+1" is added for each detected edge, and when the CR motor 30 is rotating in reverse a "−1" is added for each detected edge. Since the period of the pulses ENC is equal to the slit spacing of the linear scale 12, when the counted number is multiplied by the slit spacing, the amount that the carriage 28 has moved from when the count number is "0" can be obtained. In other words, the resolution of the linear encoder 11 in this case is the slit spacing of the linear scale 12. It is also possible to detect the position of the carriage 28 using both the pulse ENC-A and the pulse ENC-B. The periods of the pulse ENC-A and the pulse ENC-B are equal to the slit spacing of the linear scale 12, and the phases of the pulses ENC-A and ENC-B are misaligned by 90 degrees, so that if the rising edges and the falling edges of the pulses are detected and the number of detected edges is counted, then a counted number of "1" corresponds to ¼ of the slit spacing of the linear scale 12. Therefore, if the counted number is multiplied by ¼ of the slit spacing, then the amount that the carriage 28 has moved from when the count number was "0" can be obtained. That is, the resolution of the linear encoder 11 in this case is ¼ the slit spacing of the linear scale 12.

The velocity Vc of the carriage 28 is detected as follows. First, the rising edges or the falling edges of either the pulse ENC-A or ENC-B are detected. The time interval between edges of the pulses is counted with a timer counter. The period T (T=T1, T2, . . . ) is obtained from the value that is counted. Then, when the slit spacing of the linear scale 12 is regarded as λ, the velocity of the carriage can be sequentially obtained as λ/T. It is also possible to detect the velocity of the carriage 28 using both the pulse ENC-A and the pulse ENC-B. By detecting the rising edges and the falling edges of the pulses, the time interval between edges, which corresponds to ¼ of the slit spacing of the linear scale 12, is counted by the timer counter. The period T (T=T1, T2, . . . ) is obtained from the value that is counted. Then, if the slit spacing of the linear scale 12 is regarded as λ, the velocity Vc of the carriage can be found sequentially as Vc=λ/(4T).

It should be noted that the rotary encoder 13 has substantially the same configuration as the linear encoder 11, except that a rotation disk (not shown) that rotates in conjunction with rotation of the paper feed roller 24 is used in place of the linear scale 12 provided on the main printer unit, and that a detection section (not shown) provided on the main printer unit is used in place of the detection section 14 that is provided on the carriage 28.

Furthermore, the rotary encoder 13 is for detecting the rotation amount of the paper feed roller 24, and is not for directly detecting the carry amount of the print paper P. However, when the paper feed roller 24 is rotated to carry the print paper P, a carry error occurs due to slippage between the paper feed roller 24 and the print paper P. Consequently, the rotary encoder 13 cannot directly detect the carry error of the carry amount of the print paper P. Accordingly, a table (not shown) that expresses the relationship between the rotation amount of the paper feed roller 24 detected by the rotary encoder 13 and the carry error of the carry amount of the print paper P is created, and this table is stored in the memory of the main printer unit. Then, correction is performed to eliminate the carry error by referencing the corresponding carry error from the table based on the rotation amount of the paper feed roller 24 detected by the rotary encoder 13. It should be noted that the table is not limited to expressing the relationship between the rotation amount of the paper feed roller 24 and the carry error of the carry amount of the print paper P, and may also be a table that expresses the relationship between the number of times the print paper P is carried and the carry error. Also, because slippage between the paper feed roller 24 and the print paper P differs depending on the type of paper, it is also possible to store tables in the memory that correspond to paper types. Considering the possibility that the table data will be updated in the future, it is preferable that an electrically rewritable EEPROM is used as the memory that stores the tables.

===Example of Electrical Configuration of Recording Apparatus (Color Inkjet Printer)===

Figure 7:
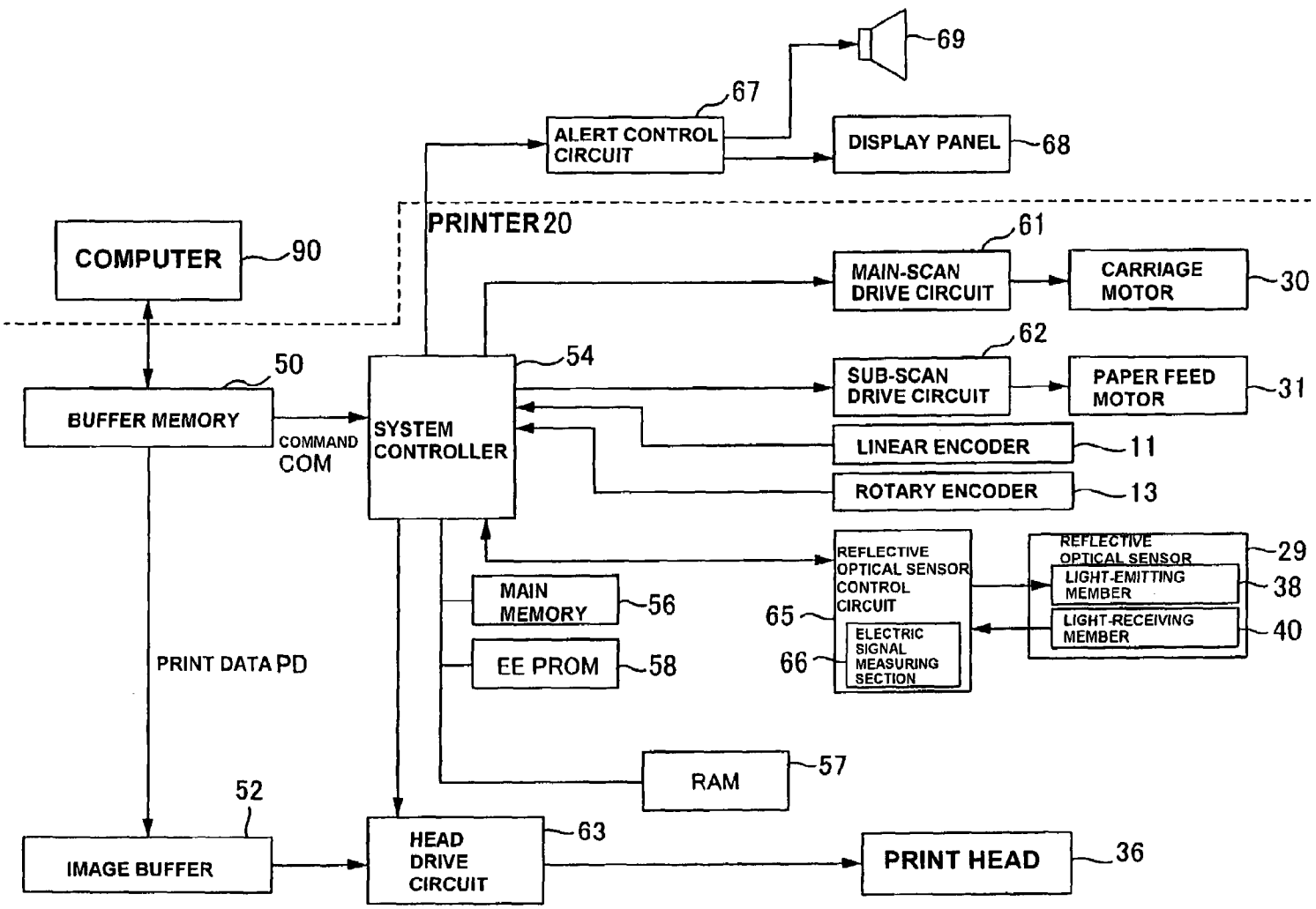
FIG. 7 is a block diagram showing an example of an electrical configuration of the color inkjet printer 20.

FIG. 7 is a block diagram showing an example of the electrical configuration of the color inkjet printer 20. Within the color inkjet printer 20, a buffer memory 50 is provided to temporarily store signals supplied from the computer 90. An image buffer 52 is supplied with the print data PD temporarily stored in the buffer memory 50. A system controller 54 is supplied with the various commands COM temporarily stored in the buffer memory 50.

A main memory 56 is connected to the system controller 54 and stores data such as program data for controlling the operation of the color inkjet printer 20 regardless of the interface between the computer 90 and the buffer memory 50, and table data to be referenced when controlling the operation of the color inkjet printer 20. It should be noted that either a non-volatile storage element (such as a mask ROM to which data are permanently recorded during the manufacturing process, an EPROM in which data can be erased by ultraviolet light, or an EEPROM in which data can be rewritten electrically) or a volatile storage element (such as an SRAM that can hold data through a backup power source) may be employed as the main memory 56, but it is preferable that a non-volatile storage device is used so as to ensure the data are held.

An EEPROM 58 rewrites and stores information each time the amount of remaining ink changes in a print operation, and is connected to the system controller 54.

Moreover, the system controller 54 is connected to a RAM 57 that stores task data, a main-scan drive circuit 61 for driving the CR motor 30, a sub-scan drive circuit 62 for driving the PF motor 31, a head drive circuit 63 for driving the print head 36, a reflective optical sensor control circuit 65 for controlling the light-emitting member 38 and the light-receiving member 40 constituting the reflective optical sensor 29, the linear encoder 11, and the rotary encoder 13. It should be noted that the reflective optical sensor control circuit 65 has an electric signal measuring section 66 for measuring the electric signals that correspond to the intensity of the reflected light obtained from the light-receiving member 40.

In this way, the system controller 54 decodes the various commands COM that are supplied from the buffer memory 50, and appropriately supplies control signals obtained from the result of this decoding to the main-scan drive circuit 61, the sub-scan drive circuit 62, and the head drive circuit 63, for example. In particular, the head drive circuit 63 reads out each of the color components that constitutes the print data PD from the image buffer 52 in accordance with the control signals supplied from the system controller 54, and drives the nozzle arrays of each color (black, yellow, magenta, and cyan) constituting the print head 36 in correspondence with each of the color components.

An alert control circuit 67 is connected to the system controller 54 and is for outputting a control signal for an alert when there is a problem in a carrying operation of the print paper P inserted in the color inkjet printer 20. Then, in accordance with an instruction from the system controller 54 when the carrying operation of the print paper P is not correct, the alert control circuit 67 is capable of outputting at least one of a display alert and a sound alert control signal.

A display panel 68 displays contents such as "carrying mechanism did not operate properly" when supplied with the display alert control signal. The display panel 68 is an LCD or an organic EL device, for example. A speaker 69 is for emitting a sound when supplied with a sound alert control signal. It should be noted that a unit separate from the color inkjet printer 20 may be used for the speaker 69.

===Example of Print Head Nozzle Arrangement===

FIG. 8 is an explanatory diagram showing the nozzle arrangement on the bottom surface of the print head 36. On the bottom surface of the print head 36 are formed a black nozzle row K, and a yellow nozzle row Y, a magenta nozzle row M, and a cyan nozzle row C as a color nozzle row.

The black nozzle row K has 180 nozzles #1 to #180 (shown by white circles). The 180 nozzles #1 to #180 (white circles) are arranged in the sub-scanning direction shown in FIG. 2 in a straight line at a constant interval (nozzle pitch k·D). Furthermore, the yellow nozzle row Y has 60 nozzles #1 to #60 (white triangles), the magenta nozzle row M has 60 nozzles #1 to #60 (white squares), and the cyan nozzle row C has 60 nozzles #1 to #60 (white diamonds). The 180 nozzles of these #1 to #60 nozzles (white triangles, white squares, and white diamonds) are arranged in the sub-scanning direction shown in FIG. 2 in a straight line at a constant interval (nozzle pitch k·D). Here D refers to the smallest dot pitch in the sub-scanning direction (that is, the spacing at the highest resolution of the dots formed on the print paper P). For example, if the resolution is 1,440 dpi, then the spacing is $1/1{,}440$ inch (approximately 17.65 μm). Furthermore, k is an integer of 1 or more.

For example, each nozzle is provided with a piezo element (not shown) as a drive element for driving the nozzle and making it eject ink droplets. However, there is no limitation to a piezo element. It is also possible to employ a method in which an electric current is made to flow through a heat resistant element arranged in the ink compartment to vaporize the ink therein by rapidly generating heat, ejecting the ink from the nozzle by the pressure of a bubble that forms at that time.

It should be noted that, during printing, the print paper P is carried intermittently by a predetermined carry amount in the sub-scanning direction, and between these intermittent carries the carriage 28 is moved in the main-scanning direction and ink droplets are ejected from the respective nozzles.

===Printing Method of the Present Embodiment===

Figure 9:
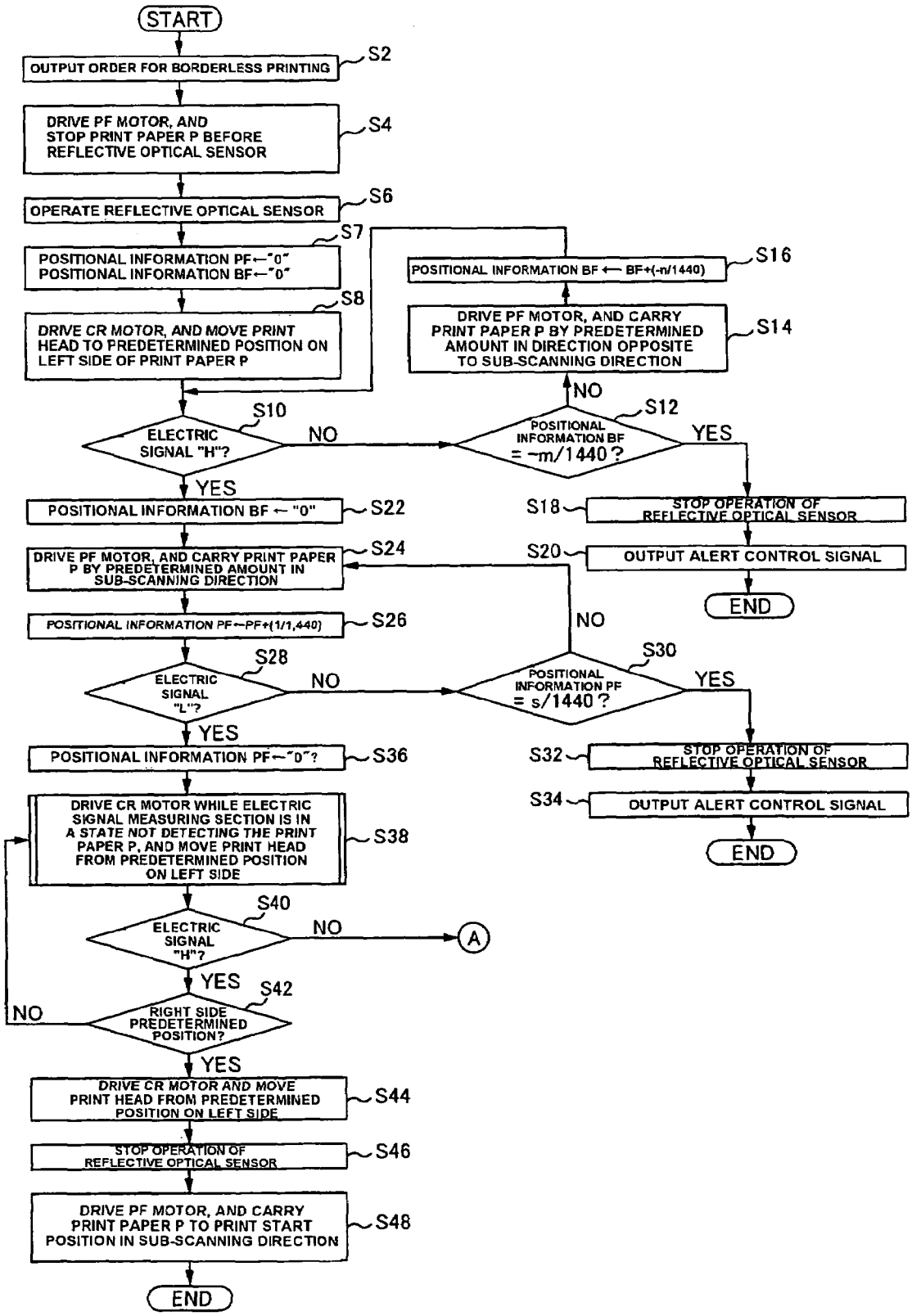
FIG. 9 is a flowchart for describing a printing method of the present embodiment.
Figure 10:
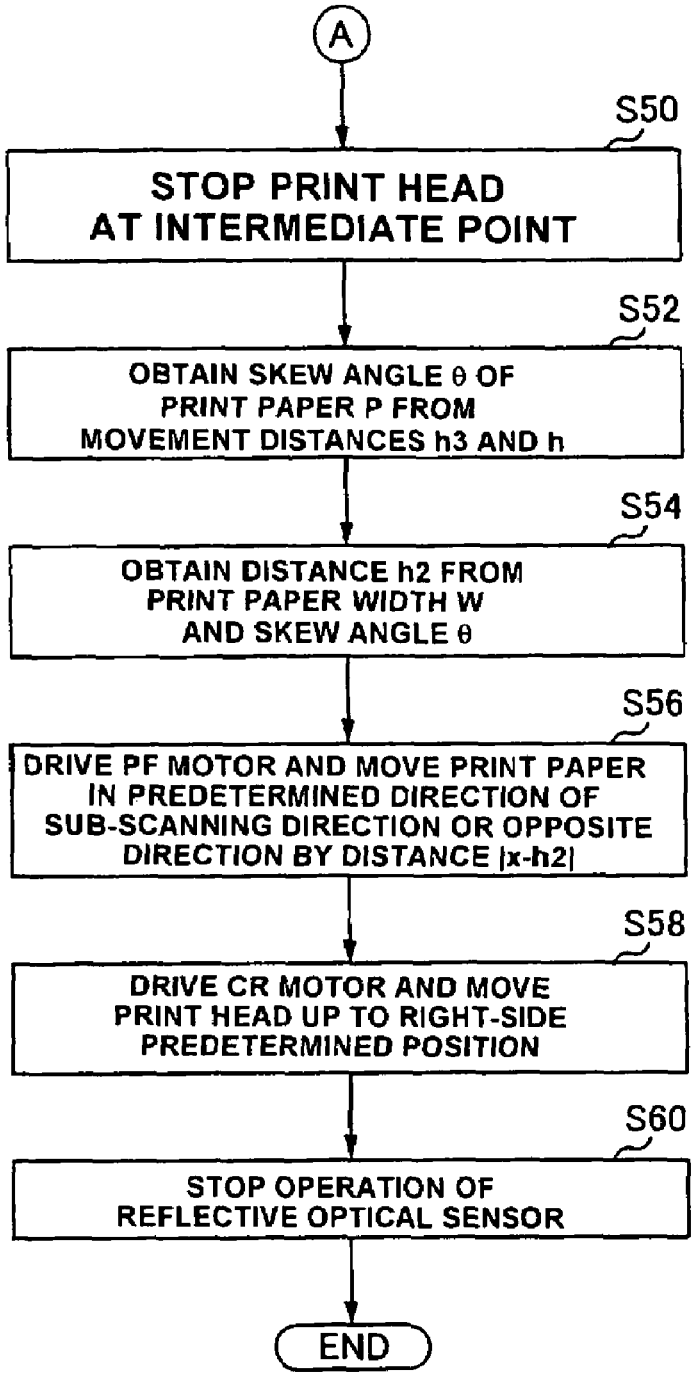
FIG. 10 is a flowchart that shows the continuation of FIG. 9.
Figure 11A:
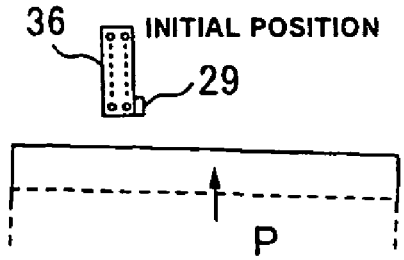
FIGS. 11A to 11F are figures for describing the positional relationship of the print head 36, the reflective optical sensor 29, and the print paper P when the upper left edge of the print paper P in the sub-scanning direction leads the upper right edge.
Figure 11B:
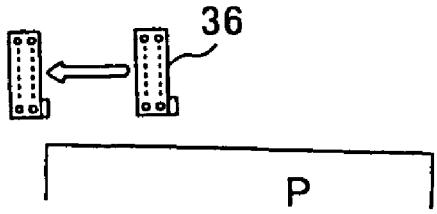
Figure 11C:
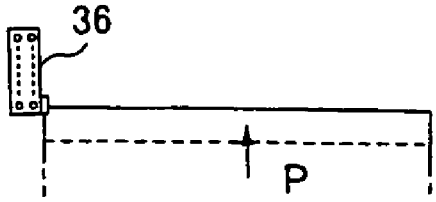
Figure 11D:
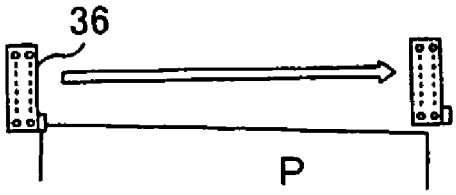
Figure 11E:
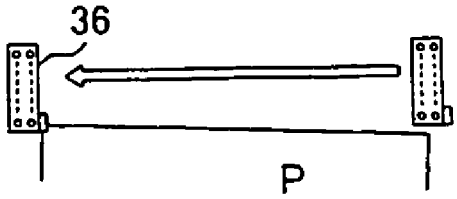
Figure 11F:
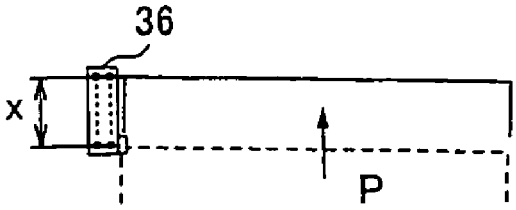
Figure 12A:
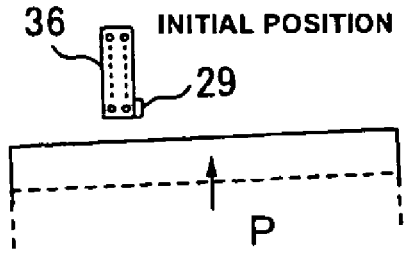
FIGS. 12A to 12F are figures for describing the positional relationship of the print head 36, the reflective optical sensor 29, and the print paper P when the upper right edge of the print paper P in the sub-scanning direction leads the upper left edge by less than a distance h.
Figure 12B:
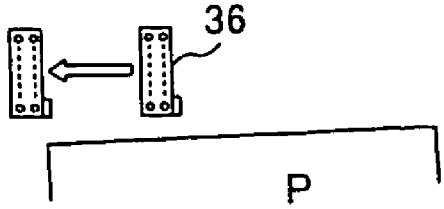
Figure 12C:
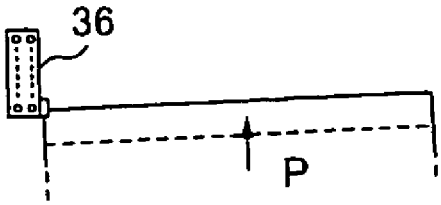
Figure 12D:
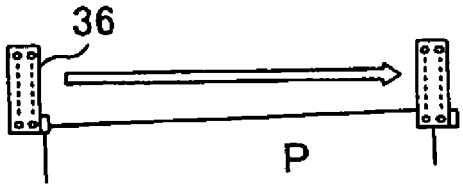
Figure 12E:
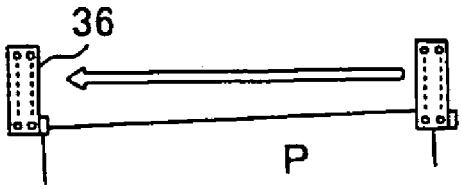
Figure 12F:
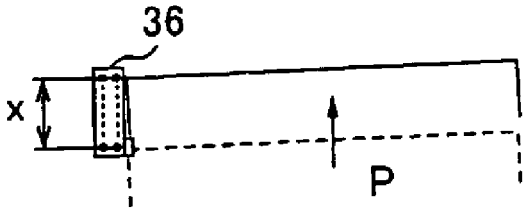
Figure 13A:
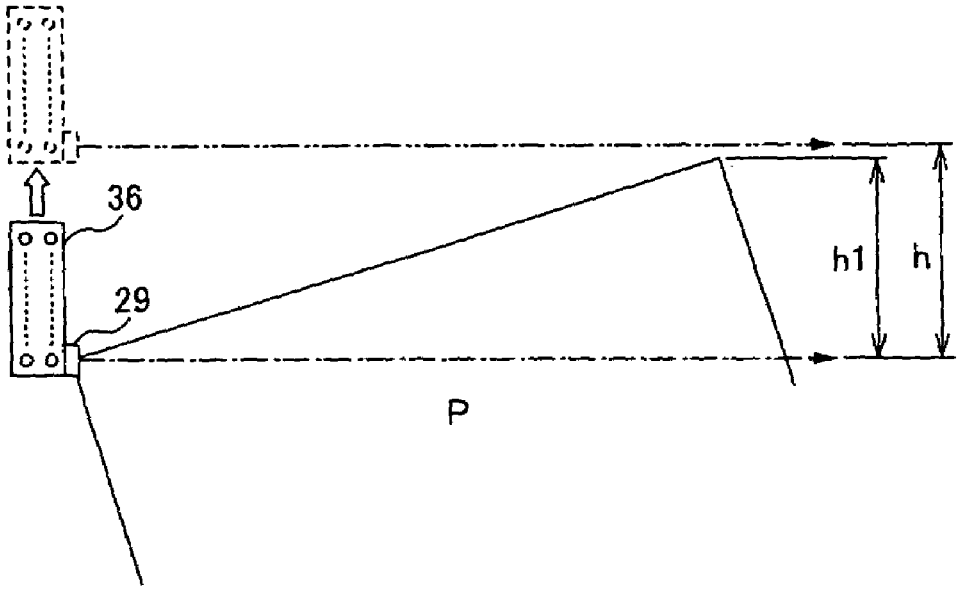
FIG. 13A is a first drawing for describing FIG. 12D in detail.
Figure 13B:
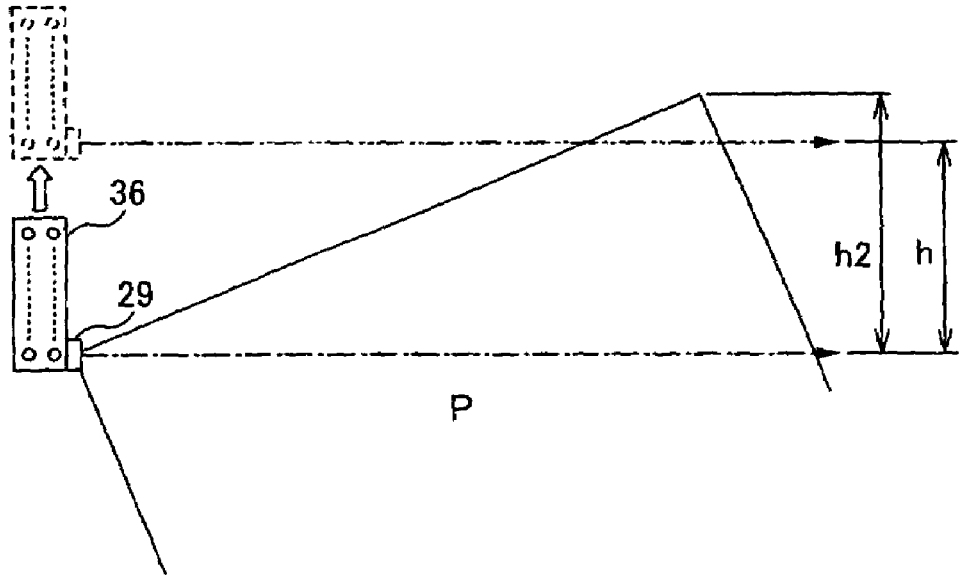
FIG. 13B is a second drawing for describing FIG. 12D in detail.
Figures 14A, 14B, 14C, 14D, 14E, 14F:
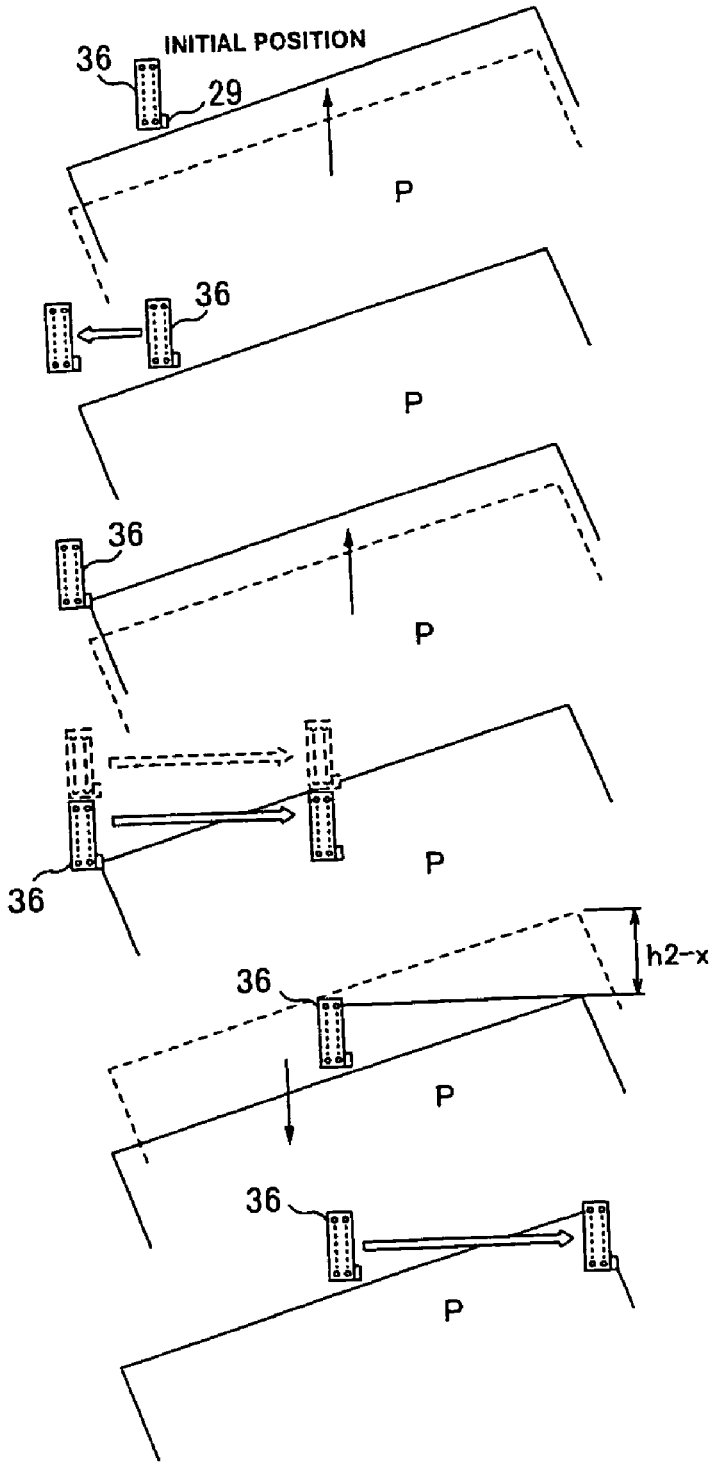
FIGS. 14A to 14F are figures for describing the positional relationship of the print head 36, the reflective optical sensor 29, and the print paper P when the upper right edge of the print paper P in the sub-scanning direction leads the upper left edge by a distance greater than h.
Figure 15:
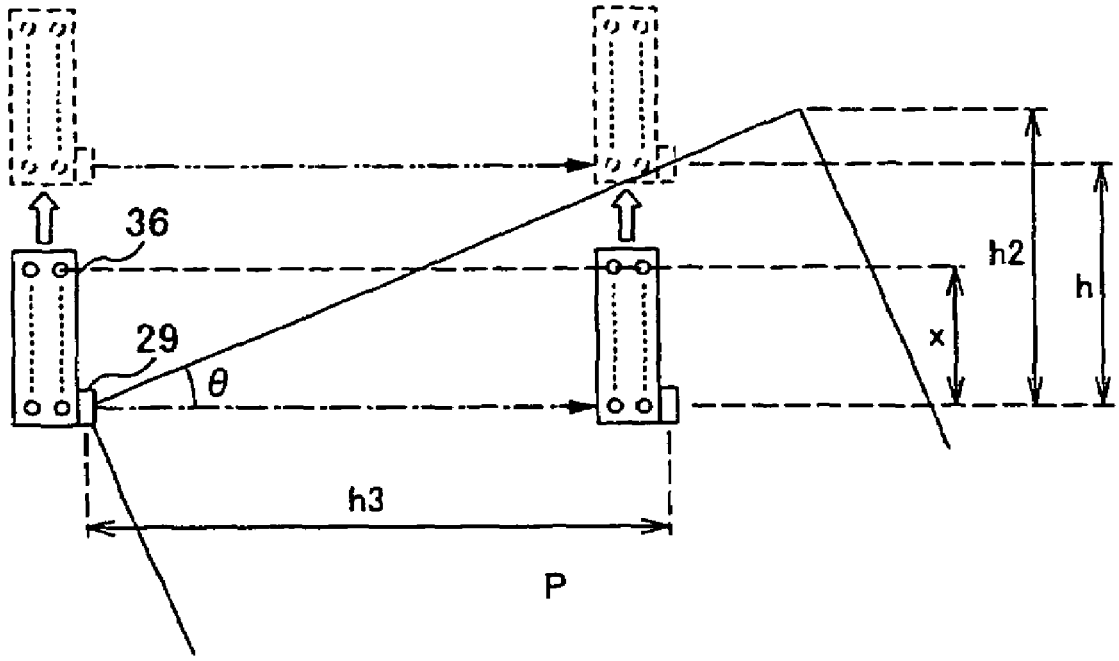
FIG. 15 is a drawing for describing the obtaining of a skew angle of the print paper P in the sub-scanning direction, and a distance by which the upper right edge of the print paper P leads the upper left edge in the sub-scanning direction.

Next, a printing method of the present embodiment will be described using FIG. 9, FIG. 10, FIGS. 11A to 11F, FIGS. 12A to 12F, FIG. 13A, FIG. 13B, FIGS. 14A to 14F, and FIG. 15. FIGS. 9 and 10 are flowcharts for describing a printing method of the present embodiment. FIGS. 1A to 11F are six drawings for describing the positional relationship of the print head 36, the reflective optical sensor 29, and the print paper P when the upper left edge of the print paper P in the sub-scanning direction leads the upper right edge. FIGS. 12A to 12F are six drawings for describing the positional relationship of the print head 36, the reflective optical sensor 29, and the print paper P when the upper right edge of the print paper P in the sub-scanning direction leads the upper left edge by a distance less than h. FIGS. 13A and 13B are two drawings for describing FIG. 12D in detail. FIGS. 14A to 14F are six drawings for describing the positional relationship of the print head 36, the reflective optical sensor 29, and the print paper P when the upper right edge of the print paper P in the sub-scanning direction leads the upper left edge by a distance greater than h. FIG. 15 is a drawing for describing how the skew angle of the print paper P in the sub-scanning direction, and the distance by which the upper right edge of the print paper P leads the upper left edge in the sub-scanning direction are obtained. It should be noted that in FIGS. 11A to 11F through FIG. 15, the white circles in the print head 36 on the upper side of each page indicate the black nozzle #1 and the yellow nozzle #1, and the white circles in the print head 36 on the lower side of each page indicate the black nozzle #180 and the cyan nozzle #60. Furthermore, during printing, the print paper P is carried from the side of the black nozzle #180 and the cyan nozzle #60 shown in FIG. 8 in the sub-scanning direction, and the reflective optical sensor 29 is positioned beside a predetermined nozzle (for instance, black nozzle #180) in the main-scanning direction.

First, when the system controller 54 is turned on, control signals for initialization are supplied to the main-scan drive circuit 61, the sub-scan drive circuit 62, and the head drive circuit 63 in accordance with the results of the decoding of initialization program data that are read from the main memory 56. In this way, the drive force of the CR motor 30 is conveyed to the carriage 28, which stops at a predetermined initial position in the main-scanning direction. That is, the print head 36 provided on the carriage 28 also stops at the same initial position (see FIGS. 11A and 12A).

If the application program 95 receives an instruction from a user for borderless printing of a specified image while the print head 36 is stopped at the initial position, then the application program 95 outputs a print order for borderless printing of the specified image to control the video driver 91 and the printer driver 96. By doing this, the printer driver 96 receives image data for borderless printing of a specified image from the application program 95, and this data is processed into the print data PD and the various commands COM and supplied to the color inkjet printer 20. In accordance with the print data PD and the various commands COM, the color inkjet printer 20 supplies control signals for borderless printing of the specified image to the main-scan drive circuit 61, the sub-scan drive circuit 62, the head drive circuit 63, and the reflective optical sensor control circuit 65, thus executing the following sequence (S2).

The sub-scan drive circuit 62 drives the PF motor 31 so that the print paper P stops before the stop position of the reflective optical sensor 29. By doing this, the print paper P stops at a position in which it does not receive the light irradiated from the reflective optical sensor 29 (see FIGS. 11A and 12A). It should be noted that the rotation amount of the PF motor 31 is set so that the print paper P does not receive the light irradiated from the reflective optical sensor 29, even when assuming the maximum skew of the upper edge of the print paper P in the sub-scanning direction (S4).

The reflective optical sensor control circuit 65 puts the reflective optical sensor 29 into the operative state. That is, it is put into the state to perform the operation of the light-emitting member 38 emitting light, and the light-receiving member 40 receiving the light emitted from the light-emitting member 38 and converting it into electric signals (S6).

In order to determine the position of the upper edge of the print paper P when the print paper P is stopped before the reflective optical sensor 29 in step S4, the system controller 54 writes into the RAM 57 a "0," which serves as positional information PF of the upper edge of the print paper P when the print paper P is carried in the sub-scanning direction, and writes into a different address of the RAM 57 a "0" as positional information BF of the upper edge of the print paper P when the print paper P is carried in the direction opposite to the sub-scanning direction (S7).

The main-scan drive circuit 61 drives the CR motor 30 so that the print head 36 stops at a predetermined position on the left edge side of the print paper P in the main-scanning direction. In this way, the print head 36 moves from the initial position up to the predetermined position of the left edge of the print paper P, and stops. It should be noted that the predetermined position of the left edge of the print paper P is a position slightly to the right side from the left edge of the print paper P (S8/see FIGS. 11B and 12B).

The electric signal measuring section 66 of the reflective optical sensor control circuit 65 measures the intensity of the electric signal obtained from the light-receiving member 40 when the print head 36 is stopped at the predetermined position on the left edge of the print paper P. The measurement result obtained from the electric signal measuring section 66 is supplied to the system controller 54. It should be noted that, as for the measurement result obtained from the electric signal measuring section 66, the internal logic of the electric signal measuring section 66 is configured so that at normal measurement accuracy, the measurement result becomes the logic value "H" when the light-emitting member 38 emits light onto the platen 26 based on the intensity of the electric signal of the light-receiving member 40, and the measurement result becomes the logic value "L" when the light-emitting member 38 emits light onto the print paper P based on the intensity of the electric signal of the light-receiving member 40 (S10).

When the measurement result obtained from the electric signal measuring section 66 is the logic value "L" (S10: NO), the system controller 54 determines that light is irradiated onto the print paper P in a state in which the upper left edge leads the upper right edge in the sub-scanning direction, and supplies a control signal to the sub-scan drive circuit 62 to drive in steps the PF motor 31.

The sub-scan drive circuit 62 drives in steps the PF motor 31 so that the print paper P is carried by a unit of a predetermined amount in the direction opposite the sub-scanning direction. It should be noted that the predetermined amount at this time is an integer multiple n (n is an integer of 1 or greater) of the smallest dot pitch in the sub-scanning direction. For example, when the resolution in the sub-scanning direction is 1,440 dpi, the predetermined amount is n/1,440 inch. In this way, the print paper P is carried by the predetermined amount in the direction opposite the sub-scanning direction (S14).

Based on the predetermined amount (for instance, n/1,440 inch) by which the print paper P was carried in the direction opposite the sub-scanning direction, the system controller 54 writes positional information BF of the upper edge of the print paper P as "0−n/1,440"="−n/1,440" into the RAM 57. That is, logically, the print paper P is successively carried in the direction opposite the sub-scanning direction from the stop position in step S4 by a unit of n/1,440 inch (S16).

When the print paper P is carried in the direction opposite the sub-scanning direction in steps S14 and S16, the electric signal measuring section 66 of the reflective optical sensor control circuit 65 once again measures the intensity of the electric signal obtained from the light-receiving member 40 when the print head 36 is stopped at the predetermined position at the left edge of the print paper P. If the measurement result obtained at this time from the electric signal measuring section 66 is the logic value "L", then the system controller 54 determines whether or not the positional information BF of the upper edge of the print paper P in the RAM 57 has reached "−m/1,440" (S12).

If the positional information BF of the upper edge of the print paper P in the RAM 57 has not reached "−m/1,440" (m>n) (S12: NO), then the procedure is once again executed from step S14, but if the positional information BF of the upper edge of the print paper P in the RAM 57 has reached "−m/1,440" (S12: YES), then the system controller 54 determines that the light is still irradiated on the print paper P even though the print paper P should have been carried in the direction opposite the sub-scanning direction by m/1,440 inches from the stop position in step S4, and thus that paper jam etc. has occurred due to failure of the carrying mechanism of the print paper P. Thus, the reflective optical sensor control circuit 65 sets the reflective optical sensor 29 to a stopped state in which light emission and light reception are not performed (S18). Moreover, the system controller 54 issues an instruction to the alert control circuit 67 for alerting that the print paper P carrying mechanism has failed, for example, and the alert control circuit 67 supplies display and sound alert control signals to the display panel 68 and the speaker 69. Thus, the display panel 68 displays a message such as "carrying mechanism did not function properly," and the speaker 69 emits a sound such as a beep, thus completing one series of processing steps (S20).

In step S10, the system controller 54 determines that light is emitted onto the platen 26 when the measurement result obtained from the electric signal measuring section 66 is the logic value "H" (S10: YES). At this time, "0" is written again only if steps S14 and S16 are executed to rewrite the positional information BF of the upper edge of the print paper P in the RAM 57 (S22).

Then, the system controller 54 supplies to the sub-scan drive circuit 62 a control signal for step-driving the PF motor 31. The sub-scan drive circuit 62 drives the PF motor 31 in steps so that the print paper P is carried in the sub-scanning direction in units of a predetermined amount. It should be noted that the predetermined amount at this time is the smallest dot pitch in the sub-scanning direction. For example, when the resolution is 1,440 dpi, the predetermined amount is $1/1{,}440$ inch (approx. 17.65 μm). In this way, the print paper P is carried by the predetermined amount in the sub-scanning direction (S24).

Based on the fact that the print paper P was carried in the sub-scanning direction by the predetermined amount (for instance, $1/1{,}440$ inch), the system controller 54 writes positional information PF of the upper edge of the print paper P of "$0+1/1{,}440$"="$1/1{,}440$" to the RAM 57. That is, logically, the print paper P is successively carried in the sub-scanning direction from the stop position in step S10 by a unit of $1/1{,}440$ inch (S26).

The electric signal measuring section 66 of the reflective optical sensor control circuit 65 again measures the intensity of the electric signal obtained from the light-receiving member 40 when the print head 36 is stopped at the predetermined position of the left edge of the print paper P.

The measurement result obtained by the electric signal measuring section 66 is supplied to the system controller 54. (S28)

If the measurement result obtained at this time from the electric signal measuring section 66 is the logic value "H" (S28: NO), then it is assumed that light is not emitted onto the print paper P, and the system controller 54 determines whether or not the positional information PF of the upper edge of the print paper P in the RAM 57 has reached "s/1,440" (s>1) (S30).

If the positional information PF of the upper edge of the print paper P in the RAM 57 has not reached "s/1,440" (S30: NO), then the procedure is executed again from step S24, and if the positional information PF of the upper edge of the print paper P in the RAM 57 has reached "s/1,440" (S30: YES), then the system controller 54 determines that the light being emitted on the platen 26 even though the print paper P should have been carried in the sub-scanning direction by s/1,440 inches from the stop position in step S10 means that either the amount of light emitted from the light-emitting member 38 is no longer at a correct amount, or that a failure of the carrying mechanism of the print paper P has occurred and the print paper P can no longer be carried in the sub-scanning direction. In this way, the reflective optical sensor control circuit 65 sets the reflective optical sensor 29 to a stopped state in which light emission and light reception are not performed (S32). Also, the system controller 54 issues an instruction to the alert control circuit 67 for alerting that the amount of light emitted from the light-emitting member 38 is no longer at a correct amount, or that the carrying mechanism of the print paper P has failed, and the alert control circuit 67 supplies display and sound alert control signals to the display panel 68 and the speaker 69. In this way, the display panel 68 displays contents such as "sensor is not operating properly" or "carrying mechanism is not operating properly," and the speaker 69 emits a sound such as a beep, and one series of processes is ended (S34).

When the measurement result obtained from the electric signal measuring section 66 changes from the logic value "H" to the logic value "L" in step S28 (S28: YES), the system controller 54 determines that the upper left edge of the print paper P in the sub-scanning direction has been irradiated with light. At this time, if the negative branch of step S10 has been executed, then the system controller 54 determines that the upper left edge of the print paper P in the sub-scanning direction leads the upper right edge (see FIG. 11C), and if step S10 has not been negated even once and the positive branch is executed, the system controller 54 determines that the upper right edge of the print paper P in the sub-scanning direction leads the upper left edge (see FIG. 12C), and writes positional information PF of the upper edge of the print paper P of "0" to the RAM 57 (S36).

The system controller 54 supplies to the main-scan drive circuit 61 a control signal for driving the CR motor 30. Also, the system controller 54 supplies to the reflective optical sensor control circuit 65 such a control signal as to make the light irradiated onto the print paper P difficult for the electric signal measuring section 66 to detect. It should be noted that, as methods for making the light irradiated onto the print paper P difficult for the electric signal measuring section 66 to detect, it is possible to consider methods such as reducing the amount of light emitted from the light-emitting member 38, reducing the light receptivity of the light-receiving member 40, and changing the threshold value by which the electric signal measuring section 66 determines that light is emitted onto the print paper P. Note, however, that as long as the result is that the light irradiated onto the print paper P becomes difficult for the electric signal measuring section 66 to detect, methods other than those described above may also be adopted. For example, the amount of light emitted from the light-emitting member 38, the light receptivity of the light-receiving member 40, and the threshold value by which the electric signal measuring section 66 determines that light is emitted onto the print paper P can be retained while a method for carrying the print paper P in the direction opposite the sub-scanning direction by a predetermined amount (for instance, distance h) is adopted. In this way, the print head 36 begins to move from the predetermined position of the left edge of the print paper P in the main scanning direction toward a predetermined position of the right edge in conjunction with movement of the carriage 28 (see FIGS. 11D and 12D). It should be noted that the predetermined position of the right edge of the print paper P is a position slightly to the left of the right edge of the print paper P. At the same time, while the electric signal measuring section 66 is in a state in which detection of the light irradiated onto the print paper P is made difficult for the measuring section, it begins measuring the intensity of the electric signal obtained from the light-receiving member 40 (S38). Then, the result of the measurement by the electric signal measuring section 66 is supplied to the system controller 54 (S40).

Specifically, making it difficult for the electric signal measuring section 66 to detect irradiation onto the print paper P is equivalent to the print head 36 beginning to move in the main scanning direction from a predetermined position of the left side toward a predetermined position of the right side of the print paper P, in a state where the print head 36 has apparently moved in the sub-scanning direction in correspondence with the degree in which it is made difficult for the electric signal measuring section 66 to detect irradiation onto the print paper P.

For example, in step S38, when the upper right edge of the print paper P leads the upper left edge in the sub-scanning direction by just a distance h1 (<distance h), the electric signal measuring section 66 continues to output the logic value "H" even if the print head 36 is moved in the main scanning direction from the predetermined position on the left side to the predetermined position on the right side, and does not detect light being irradiated to the print paper P. In other words, the system controller 54 executes the same processing as when the upper left edge of the print paper P leads the upper right edge in the sub-scanning direction under the assumption that the distance h1 by which the upper right edge of the print paper P leads the upper left edge in the sub-scanning direction is small and does not affect borderless printing (see FIG. 13A).

On the other hand, in step S38, when the upper right edge of the print paper P leads the upper left edge in the sub-scanning direction by a distance h2 (>distance h), the electric signal measuring section 66 outputs the logic value "L" at an intermediate point when the print head 36 has moved in the main scanning direction from the predetermined position on the left side to the predetermined position on the right side of the print paper P, and light irradiated onto the print paper P is detected. In other words, the system controller 54 executes a different process from when the upper left edge of the print paper P leads the upper right edge in the sub-scanning direction under the assumption that the distance h2 by which the upper right edge of the print paper P leads the upper left edge in the sub-scanning direction is large and would affect borderless printing (see FIG. 13B).

If the measurement result obtained from the electric signal measuring section 66 is the logic value "H" (S40: YES), the system controller 54 continues the determination of step S40 until the print head 36 moves in the main scanning direction from the predetermined position on the left side of the print paper P until the predetermined position on the right side (S42).

When the measurement result obtained from the electric signal measuring section 66 is the logic value "H" (S42: YES) from the predetermined position on the left side of the print paper P until the predetermined position on the right side, the system controller 54 determines whether the carrying state of the print paper P is that the upper left edge of the print paper P leads the upper right edge in the sub-scanning direction, or that the upper right edge of the print paper P leads the upper left edge in the sub-scanning direction by the distance h1. Then, the main-scan drive circuit 61 drives the CR motor 30 so that the print head 36 moves from the predetermined position on the right side of the print paper P to the predetermined position on the left side (see FIGS. 11E and 12E). In this way, the print head 36 stops at the predetermined position on the left side of the print paper P (S44).

The reflective optical sensor control circuit 65 sets the reflective optical sensor 29 to a stopped state in which light emission and light reception are not performed (S46).

The system controller 54 supplies the sub-scan drive circuit 62 with a control signal for driving the PF motor 31. The sub-scan drive circuit 62 drives the PF motor 31 so that the upper left edge of the print paper P is at the leading position of the print head 36 (position of the black nozzle #1 and the yellow nozzle #1). In this way, the print paper P is carried in the sub-scanning direction by just a distance x (=179 kD) between #1 to #180 of the black nozzle row K of the print head 36, and the upper left edge of the print paper P is positioned on the same line as the leading position of the print head 36 in the main scanning direction. In other words, the print start position of the print paper P in the sub-scanning direction is determined (see FIGS. 11F and 12F). Then borderless printing of the predetermined image specified by the user is performed. It should be noted that it is also possible to shorten the distance x and eject ink also from above the upper left edge of the print paper P so as to reliably perform borderless printing (S48).

It should be noted that it is also possible to omit the above-described step S44 and perform only a first printing in the main scanning direction by moving the print head 36 from the right side of the print paper P to the left side. Furthermore, the carrying distance of the print paper P in FIGS. 11F and 12F is not limited to x. For example, depending on the various printing modes, the print paper P may be carried so that the upper left edge of the print paper P is positioned at any position of the black nozzle row #1 to #180.

Incidentally, if the measurement result obtained from the electric signal measuring section 66 changes to the logic value "L" (S40: NO) at an intermediate point as the print head 36 moves in the main scanning direction from the predetermined position on the left side to the predetermined position on the right side of the print paper P, the system controller 54 determines that the upper right edge of the print paper P leads the upper left edge in the sub-scanning direction by a distance h2 (>distance h) as regards the carrying state of the print paper P. That is, it determines that there is an effect on borderless printing. At this time, the main-scan drive circuit 61 stops driving the CR motor 30. In this way, the print head 36 stops at the above-mentioned intermediate point in the main scanning direction (S50/see FIG. 14D).

The system controller 54 obtains a movement distance h3 of the reflective optical sensor 29 in the main scanning direction based on a predetermined calculation that expresses the relationship between the slit spacing λ and the count value of the linear encoder 11 when the print head 36 has moved from a predetermined position on the left side of the print paper P to the above-described intermediate point. It should be noted that the apparent movement distance h of the reflective optical sensor 29 in the sub-scanning direction for when it is made difficult for the electric signal measuring section 66 of the reflective optical sensor control circuit 65 to detect irradiation onto the print paper P is written to the EEPROM 58 as table data. Accordingly, based on a predetermined calculation related to a trigonometric function (tan) using the movement distances h3 and h, the system controller 54 obtains the skew angle θ of the print paper P in the sub-scanning direction (S52/see FIG. 15).

The system controller 54 then performs a predetermined calculation related to the trigonometric function (tan) using the width W of the print paper designated in the user interface display module 101 and the skew angle θ of the print paper P in the sub-scanning direction to obtain the distance h2 between the upper right edge of the print paper P and the upper left edge in the sub-scanning direction as a specific numerical value (S54/see FIG. 15).

The system controller 54 obtains the difference between the distance x between nozzles #1 to #180 of the black nozzle row K of the print head 36 and the distance h2 between the upper right edge of the print paper P and the upper left edge in the sub-scanning direction. It then supplies a control signal for driving the PF motor 31 in accordance with this difference to the sub-scan drive circuit 62. More specifically, if the distance x is smaller than the distance h2, then the upper right edge of the print paper P leads the nozzle #1 of the black nozzle row K of the print head 36 in the sub-scanning direction, and therefore the sub-scan drive circuit 62 supplies to the PF motor 31 a drive signal for carrying the print paper P in the direction opposite the sub-scanning direction by the amount of the above-described difference. In this way, the upper right edge of the print paper P matches the nozzle #1 of the black nozzle row K of the print head 36 in the main scanning direction. On the other hand, if the distance x is greater than the distance h2, then the nozzle #1 of the black nozzle row K #1 of the print head 36 leads the upper right edge of the print paper P in the sub-scanning direction, and therefore the sub-scan drive circuit 62 supplies to the PF motor 31 a drive signal for carrying the print paper P in the sub-scanning direction by the amount of the above difference. In this way, the upper right edge of the print paper P matches the nozzle #1 of the black nozzle row K of the print head 36 in the main scanning direction. It should be noted that it is also possible to shorten the carrying distance of the print paper P and eject ink from above the upper right edge of the print paper P so that borderless printing can be carried out reliably. Furthermore, the distance that the print paper P is carried is not limited to the above description. For example, depending on the various printing modes, the print paper P may be carried so that the upper right edge of the print paper P is positioned at any nozzle #1 to #180 of the black nozzle row (S56).

The system controller 54 supplies a control signal for driving the CR motor 30 to the main-scan drive circuit 61. The system controller 54 also supplies a control signal to the reflective optical sensor control circuit 65 for the electric signal measuring section 66 to detect light irradiated to the print paper P with normal measurement precision. In this way, the print head 36 moves from the stop position shown in FIGS. 14D and 14E to a predetermined position on the right side in accordance with movement of the carriage 28, and stops (see FIG. 14F). At the same time, the electric signal measuring section 66 returns to a state where the intensity of the electric signal obtained from the light-receiving member 40 can be measured with normal measurement precision. It should be noted that it is also possible for the print head 36 to move from the stop position shown in FIGS. 14D and 14E to a predetermined position on the left side and stop (S58).

The reflective optical sensor control circuit 65 sets the reflective optical sensor 29 to a stopped state in which light emission and light reception are not performed (S60). The print start position of the print paper P in the sub-scanning direction is thus determined. Then, borderless printing of the predetermined image specified by the user is executed.

Incidentally, when the print paper P is carried in a direction toward the print head 36, if it is carried while either of the right upper edge or left upper edge of the print paper P leads the other edge, that is, if the print paper P is carried while skewed in the carrying direction, the actual printing position on the print paper P will be displaced from the intended printing position, and thus the quality of the printed image may be affected. In particular, when performing borderless printing, a skew in the print paper P in the carrying direction can cause blank areas on the upper edge of the print paper P, and this alone may make the print paper P unusable. On the other hand, when performing borderless printing, although enlarging the margin of the printing area in regard to the print paper P makes it difficult for blank areas to appear on the upper edge of the print paper P, the amount of ink consumed may increase.

Accordingly, after the reflective optical sensor 29 detects the upper edge of the print paper P that is carried, if the reflective optical sensor 29 that once entered a state in which the electric signal measuring section 66 of the reflective optical sensor control circuit 65 does not output the logic value "L" again detects the print paper P in the process of moving from one edge to the other edge, then the distance by which the upper edge of the other edge side of the print paper P leads the upper edge of the one edge side is obtained based on the carrying distance of the print paper P that is required for the reflective optical sensor 29 in this state to again detect the upper edge of the print paper P at the one edge side and the movement distance for when the reflective optical sensor 29 in this state moves from the one edge side to the position where the print paper P is detected, and the print paper P is carried by an amount that corresponds to this leading distance. It is thus possible to effectively obtain the print start position for the print paper P with high precision and in a short time. In other words, it is possible to solve the problems of blank spaces being formed on the upper edge of the print paper P, and of the increase in the amount of ink consumed when performing borderless printing.

Furthermore, the reflective optical sensor control circuit 65 may also lower the detection sensitivity of the reflective optical sensor 29 so that the sensor is brought into a state in which it does not detect the print paper P.

In this way, it is possible to effectively obtain the print start position for the recording medium with high precision and in a short time using the reflective optical sensor 29 in a state with lowered detection sensitivity until the electric signal measuring section 66 of the reflective optical sensor control circuit 65 no longer outputs the logic value "L."

Also, the reflective optical sensor control circuit 65 can also carry the print paper P by a predetermined amount from the detection position in a direction opposite the predetermined direction so that the print paper P is not detected.

In this way, by carrying the print paper P by a predetermined amount from the detection position in a direction opposite the predetermined direction, it is possible to effectively obtain the print start position for the print paper P with high precision and in a short time using the reflective optical sensor 29 in a state in which the electric signal measuring section 66 of the reflective optical sensor control circuit 65 does not output the logic value "L."

Further, when the reflective optical sensor 29 does not detect the print paper P as it moves from the one edge side to the other edge in a state where the electric signal measuring section 66 of the reflective optical sensor control circuit 65 does not output the logic value "L," the print paper P may be carried by the PF motor 31 by a predetermined amount in the predetermined direction from the detection position.

In this way, if the reflective optical sensor 29, which has been in a state in which the electric signal measuring section 66 of the reflective optical sensor control circuit 65 does not output the logic value "L", does not detect the print paper P while moving from the one edge side to the other edge side, then it is determined that the one edge side of the print paper P leads the other edge, or that the other edge of the print paper P leads the one edge side by less than a predetermined amount, and the print paper P is carried. It is therefore possible to effectively obtain the print start position for the print paper P with high precision and in a short time even if one of the edges of the print paper P leads the other.

Also, if the reflective optical sensor 29, which has been in a state where the electric signal measuring section 66 of the reflective optical sensor control circuit 65 does not output the logic value "L", detects the print paper P while moving from the one edge side to the other edge side, then the skew angle at which the print paper P intersects the movement direction in which the reflective optical sensor 29 moves is obtained based on the carrying distance of the print paper P that is required for the reflective optical sensor 29 in this state to again detect the upper edge of the print paper P at the one edge side and the movement distance when the reflective optical sensor 29 in this state moves from the one edge side until the position where it detects the print paper P, and based on this skew angle and the width of the print paper P, the distance by which the upper right edge or the upper left edge of the print paper P leads the other edge can be obtained.

In this way, the skew angle of the print paper P in the direction that it intersects the movement direction of the reflective optical sensor 29 is obtained, and based on this skew angle and the width of the print paper P, the distance by which the upper edge of the other edge of the print paper P leads the upper edge of the one edge side is obtained. In this way, it is possible to effectively obtain the print start position for the print paper P with high precision and in a short time.

Also, the print head 36 for ejecting ink to print the print paper P may also be provided.

Thus, it is possible to effectively obtain the print start position for the print paper P with high precision and in a short time using the print head 36 for ejecting ink to print on the print paper P.

It is also possible to provide the reflective optical sensor 29 on the carriage 28, which can move in the above-mentioned movement direction along with the print head 36.

Thus, it is possible to effectively obtain the print start position for the print paper P with high precision and in a short time using the reflective optical sensor 29 that is provided on the carriage 28 along with the print head 36.

It is also possible for the reflective optical sensor 29 to have the light-emitting member 38 for emitting light and the light-receiving member 40 for receiving light emitted from the light-emitting member 38, and to detect the print paper P based on the output value of the light-receiving member 40.

Thus, it is possible to effectively obtain the print start position for the print paper P with high precision and in a short time using the reflective optical sensor 29 that has the light-emitting member 38 for emitting light and the light-receiving member 40 for receiving light emitted from the light-emitting member, and that detects the print paper P based on the output value of the light-receiving member 40.

OTHER EMBODIMENTS

An embodiment of a recording apparatus, a recording method, a program, and a computer system according to the present invention was described above. However, the foregoing embodiment of the invention is for the purpose of elucidating the present invention and is not to be interpreted as limiting the present invention. The invention can of course be altered and improved without departing from the gist thereof and includes functional equivalents.

<Detection of Upper Edge of Print Paper P>

In the present embodiment, the skew angle θ of the print paper P in the sub-scanning direction was obtained from the distance h and the distance h3 when the reflective optical sensor 29, which has been in a state in which the electric signal measuring section 66 of the reflective optical sensor control circuit 65 does not output the logic value "L", detects the upper edge of the print paper P while moving from one edge to the other edge, and the distance h2 by which the upper right edge of the print paper P leads the upper left edge in the sub-scanning direction is obtained from the skew angle θ and the width W of the print paper P, but this is not a limitation.

For example, the width W of the print paper set in the user interface display module 101 may be divided into a plurality of sectors, and table data for each size of print paper corresponding to the plurality of sectors with a plurality of carrying distances (distance h2) may be prepared in advance in the main memory 56, the EEPROM 58, or the like, and the print start position for the print paper P may be determined by referencing this table data.

The operation for obtaining the above carrying distance is described below with reference to FIGS. 16A, 16B, and 17. FIG. 16A shows how the width W of the print paper P is divided into five sectors W1, W2, W3, W4, and W5. FIG. 16B shows that the reflective optical sensor 29, which has been in a state in which the electric signal measuring section 66 of the reflective optical sensor control circuit 65 does not output the logic value "L", detects the upper edge of the print paper P in the sector W3 while moving from the one edge side to the other edge. FIG. 17 is a data table in which the plurality of sectors corresponds with a plurality of carrying distances. It should be noted that the carrying distance is 0 for the sector W5 furthest to the right of the print paper P.

When the reflective optical sensor 29, which has been in a state where the electric signal measuring section 66 of the reflective optical sensor control circuit 65 does not output the logic value "L", detects the upper edge of the print paper P in the divisional sector W3, the system controller 54 references a carrying distance L3 for the sector W3 in the data table shown in FIG. 17, and causes the print paper P to be carried in the sub-scanning direction by the carrying distance L3. In other words, the print paper P is carried to a position where good borderless printing can be carried out, and waits there.

It should be noted that the precision of the carrying distance of the print paper P can be improved when the number of divisions of the width W of the print paper P is set high. Furthermore, the width by which the width W of the print paper P is divided may be uniform or non-uniform. For example, when the sector furthest to the right of the print paper P is shortened, the width of the print paper P corresponding to the carrying distance of the print paper P can be made wide, and this allows the precision of the carrying distance of the print paper P to be increased.

That is, after the reflective optical sensor 29 detects the upper edge of the print paper P that is carried, if the reflective optical sensor 29 that once entered a state where the electric signal measuring section 66 of the reflective optical sensor control circuit 65 does not output the logic value "L" again detects the print paper P while moving from the one edge side to the other edge, then the distance by which the upper edge of the other edge side of the print paper P leads the upper edge of the one edge side is obtained according to which sector in the movement direction the reflective optical sensor 29 detected the print paper P in, and the printing medium P is carried by an amount corresponding to this leading distance. In this way, it is possible to effectively obtain the print start position for the print paper P in a short time. In particular, by finely subdividing the sectors in the movement direction of the reflective optical sensor 29, it is possible to obtain the print start position for the print paper P with high precision.

<Alerts>

The present embodiment was described using a case where alerts were conducted using the display panel 68 and the speaker 69 provided at the color inkjet printer 20, but there is no limitation to this. For example, it is also possible for the application program 95 to decode a command COM supplied from the color inkjet printer 20 for an alert, and drive the video driver 91 so that display contents (such as text or illustrations indicating that "carrying mechanism did not function properly") for confirming an irregularity of the color inkjet printer 20 are displayed on the CRT 21. Also, a sound may be emitted from the speaker 69 at the same. Thus, it is possible to effectively conduct an alert using the CRT 21, which is larger than the display panel 68.

<Sensor (Detection Means)>

The light-emitting member 38 and the light-receiving member 40 that make up the reflective optical sensor 29 as a sensor (detection means) are provided together with the print head 36 at the carriage 28, but there is no limitation to this. For example, it is possible to use the light-emitting member 38 and the light-receiving member 40 that are separate to the carriage 28 but that moves in the main scanning direction in synchronization with to the carriage 28. Also, the detection means is not limited to the reflective optical sensor 29. For example, a transmissive optical sensor on the path where light is emitted to and received from the print paper P, a line sensor, or an area sensor, for example, may also be employed.

<Recording Medium>

The recording medium is not limited to the print paper P. For example, cloth, thin metal plates, and film, for example, can also be used as the recording medium.

<Recording Apparatus>

The recording apparatus, as a printer, is not limited to the color inkjet printer 20. For example, it is also possible for it to be a monochrome inkjet printer, or a non-inkjet type printer, for example. In such a case, the printer may have the functions or some of the mechanisms of a computer unit, a display device, an input device, a flexible disk drive device, and a CD-ROM drive device. For example, the printer may have an image processing section for carrying out image processing, a display section for carrying out various types of displays, and a recording media attachment/detachment section for attaching and detaching a recording medium or media on which image data captured by a digital camera or the like is recorded.

Furthermore, the recording apparatus is not limited to a printer. For example, it is also possible to use a device such as a color filter manufacturing device, a dyeing device, a fine processing device, a semiconductor manufacturing device, a surface processing device, a three-dimensional shape forming machine, a liquid vaporizing device, an organic EL manufacturing device (particularly a macromolecular EL manufacturing device), a display manufacturing device, a film formation device, a DNA chip manufacturing device, and so on. When the present invention is used in these fields, since the liquid can be directly ejected (directly written) to a target object, it is possible to achieve reductions in material, process steps, and costs compared to conventional cases.

<Liquid>

The liquid is not limited to ink (such as dye inks and pigment inks). For example, it is also possible to use a liquid (including water) including metallic material, organic material (particularly macromolecular material), magnetic material, conductive material, wiring material, film-formation material, electronic ink, processed liquid, and genetic solutions.

As described above, with the present embodiment, it is possible to effectively obtain the print start position for a recording medium with high precision and in a short time.

What is claimed is:

1. A recording method for recording on a recording medium, comprising the steps of:

(a) positioning a sensor at a first end point in a movement direction of said sensor, said sensor being capable of performing a substantially linear movement from said first end point to a second end point and from said second end point back to said first end point;

(b) carrying said recording medium in a predetermined direction up to a detection position which is a position of said recording medium where said sensor detects said recording medium when said sensor is positioned at said first end point, said predetermined direction being a direction intersecting said movement direction of said sensor, and said recording medium having at least a leading edge which is the foremost edge in said predetermined direction;

(c) lowering a detection sensitivity of said sensor so that it becomes difficult for said sensor to detect said recording medium, and then moving said sensor toward said second end point; and (d) if said sensor, whose detection sensitivity has been lowered, detects said recording medium while said sensor is being moved toward said second end point, then:

obtaining a corner-to-corner distance which is a distance, in said predetermined direction, between a first corner of said recording medium formed by said leading edge of said recording medium and a first side edge thereof, and a second corner of said recording medium formed by said leading edge of said recording medium and a second side edge thereof based on a movement distance from said first end point to a position at which said sensor detected said recording medium and a virtual carrying distance which is a distance, in said predetermined direction, from said detection position in step (b) to a virtual detection position at which said sensor would detect said recording medium in step (b) if the detection sensitivity of said sensor had been lowered; and carrying said recording medium in said predetermined direction by an amount that corresponds to said corner-to-corner distance.

2. A recording method according to claim 1, wherein:

if said sensor, whose detection sensitivity has been lowered, does not detect said recording medium while said sensor is being moved toward said second end point, then said recording medium is simply carried from said detection position by a predetermined amount in said predetermined direction.

3. A recording method according to claim 1, wherein:

if said sensor, whose detection sensitivity has been lowered, detects said recording medium while said sensor is being moved toward said second end point, then:

a skew angle of said recording medium in a direction intersecting said movement direction of said sensor is obtained based on said movement distance from said first end point to the position at which said sensor detected said recording medium and said virtual carrying distance; and said corner-to-corner distance is obtained based on said skew angle and a width of said recording medium.

4. A recording method according to claim 1, wherein:

said sensor moves in said movement direction together with a recording head.

5. A recording method according to claim 4, wherein:

said recording head carries out recording with respect to an entire surface of said recording medium.

6. A recording method according to claim 1, wherein:

said sensor comprises a light-emitting member for emitting light and a light-receiving member for receiving light emitted by said light-emitting member, and detects said recording medium based on an output value of said light-receiving member.

7. A recording method for recording on a recording medium, comprising the steps of:

(a) dividing a movement direction of a sensor into a plurality of sectors and positioning said sensor at a first end point in said movement direction, said sensor being capable of performing a substantially linear movement from said first end point to a second end point and from said second end point back to said first end point;

(b) carrying said recording medium in a predetermined direction up to a detection position which is a position of said recording medium where said sensor detects said recording medium when said sensor is positioned at said first end point, said predetermined direction being a direction intersecting said movement direction of said sensor, and said recording medium having at least a leading edge which is the foremost edge in said predetermined direction;

(c) lowering a detection sensitivity of said sensor so that it becomes difficult for said sensor to detect said recording medium, and then moving said sensor toward said second end point; and (d) if said sensor, whose detection sensitivity has been lowered, detects said recording medium while said sensor is being moved toward said second end point, then:

obtaining a corner-to-corner distance which is a distance, in said predetermined direction, between a first corner of said recording medium formed by said leading edge of said recording medium and a first side edge thereof, and a second corner of said recording medium formed by said leading edge of said recording medium and a second side edge thereof, according to which sector said sensor detected said recording medium in; and carrying said recording medium in said predetermined direction by an amount that corresponds to said corner-to-corner distance.

8. A recording method according to claim 7, wherein:

if said sensor, whose detection sensitivity has been lowered, does not detect said recording medium while said sensor is being moved toward said second end point, then said recording medium is simply carried from said detection position by a predetermined amount in said predetermined direction.

9. A recording method according to claim 7, wherein:

said sensor moves in said movement direction together with a recording head.

10. A recording method according to claim 9, wherein:

said recording head carries out recording with respect to an entire surface of said recording medium.

11. A recording method according to claim 7, wherein:

said sensor comprises a light-emitting member for emitting light and a light-receiving member for receiving light emitted by said light-emitting member, and detects said recording medium based on an output value of said light-receiving member.

12. A recording apparatus for recording on a recording medium, comprising:

a movable sensor for detecting said recording medium, said sensor being capable of performing a substantially linear movement from a first end point to a second end point and from said second end point back to said first end point;

a carrying mechanism for carrying said recording medium in a predetermined direction intersecting a movement direction of said sensor;

wherein;

(a) said sensor is positioned at said first end point in said movement direction of said sensor;

(b) said carrying mechanism carries said recording medium in said predetermined direction up to a detection position which is a position of said recording medium where said sensor detects said recording medium when said sensor is positioned at said first end point, said recording medium having at least a leading edge which is the foremost edge in said predetermined direction;

(c) a detection sensitivity of said sensor is lowered so that it becomes difficult for said sensor to detect said recording medium, and then said sensor is moved toward said second end point; and (d) if said sensor, whose detection sensitivity has been lowered, detects said recording medium while said sensor is being moved toward said second end point, then:

a corner-to-corner distance which is a distance, in said predetermined direction, between a first corner of said recording medium formed by said leading edge of said recording medium and a first side edge thereof, and a second corner of said recording medium formed by said leading edge of said recording medium and a second side edge thereof is obtained based on a movement distance from said first end point to a position at which said sensor detected said recording medium and a virtual carrying distance which is a distance, in said predetermined direction, from said detection position in item (b) to a virtual detection position at which said sensor would detect said recording medium in item (b) if the detection sensitivity of said sensor had been lowered; and said carrying mechanism carries said recording medium in said predetermined direction by an amount that corresponds to said corner-to-corner distance.

13. A recording apparatus for recording on a recording medium, comprising:

a movable sensor for detecting said recording medium, said sensor being capable of performing a substantially linear movement from a first end point to a second end point and from said second end point back to said first end point;

a carrying mechanism for carrying said recording medium in a predetermined direction intersecting a movement direction of said sensor;

wherein;

(a) said movement direction of said sensor is divided into a plurality of sectors, and said sensor is positioned at said first end point in said movement direction;

(b) said carrying mechanism carries said recording medium in said predetermined direction up to a detection position which is a position of said recording medium where said sensor detects said recording medium when said sensor is positioned at said first end point, said recording medium having at least a leading edge which is the foremost edge in said predetermined direction;

(c) a detection sensitivity of said sensor is lowered so that it becomes difficult for said sensor to detect said recording medium, and then said sensor is moved toward said second end point; and (d) if said sensor, whose detection sensitivity has been lowered, detects said recording medium while said sensor is being moved toward said second end point, then:

a corner-to-corner distance which is a distance, in said predetermined direction, between a first corner of said recording medium formed by said leading edge of said recording medium and a first side edge thereof, and a second corner of said recording medium formed by said leading edge of said recording medium and a second side edge thereof is obtained, according to which sector said sensor detected said recording medium in; and said carrying mechanism carries said recording medium in said predetermined direction by an amount that corresponds to said corner-to-corner distance.

14. A computer-readable medium for causing a recording apparatus to operate, comprising:

(a) a code for positioning a sensor at a first end point in a movement direction of said sensor, said sensor being capable of performing a substantially linear movement from said first end point to a second end point and from said second end point back to said first end point;

(b) a code for carrying a recording medium in a predetermined direction up to a detection position which is a position of said recording medium where said sensor detects said recording medium when said sensor is positioned at said first end point, said predetermined direction being a direction intersecting said movement direction of said sensor, and said recording medium having at least a leading edge which is the foremost edge in said predetermined direction;

(c) a code for lowering a detection sensitivity of said sensor so that it becomes difficult for said sensor to detect said recording medium, and then moving said sensor toward said second end point; and (d) a code for:

obtaining a corner-to-corner distance which is a distance, in said predetermined direction, between a first corner of said recording medium formed by said leading edge of said recording medium and a first side edge thereof, and a second corner of said recording medium formed by said leading edge of said recording medium and a second side edge thereof based on a movement distance from said first end point to a position at which said sensor detected said recording medium and a virtual carrying distance which is a distance, in said predetermined direction, from said detection position in code (b) to a virtual detection position at which said sensor would detect said recording medium in code (b) if the detection sensitivity of said sensor had been lowered; and carrying said recording medium in said predetermined direction by an amount that corresponds to said corner-to-corner distance if said sensor, whose detection sensitivity has been lowered, detects said recording medium while said sensor is being moved toward said second end point.

15. A computer-readable medium for causing a recording apparatus to operate, comprising:

(a) a code for dividing a movement direction of a sensor into a plurality of sectors and positioning said sensor at a first end point in said movement direction, said sensor being capable of performing a substantially linear movement from said first end point to a second end point and from said second end point back to said first end point;

(b) a code for carrying a recording medium in a predetermined direction up to a detection position which is a position of said recording medium where said sensor detects said recording medium when said sensor is positioned at said first end point, said predetermined direction being a direction intersecting said movement direction of said sensor, and said recording medium having at least a leading edge which is the foremost edge in said predetermined direction;

(c) a code for lowering a detection sensitivity of said sensor so that it becomes difficult for said sensor to detect said recording medium, and then moving said sensor toward said second end point; and (d) a code for:

obtaining a corner-to-corner distance which is a distance, in said predetermined direction, between a first corner of said recording medium formed by said leading edge of said recording medium and a first side edge thereof, and a second corner of said recording medium formed by said leading edge of said recording medium and a second side edge thereof, according to which sector said sensor detected said recording medium in; and carrying said recording medium in said predetermined direction by an amount that corresponds to said corner-to-corner distance if said sensor, whose detection sensitivity has been lowered, detects said recording medium while said sensor is being moved toward said second end point.

16. A recording method for recording on a recording medium, comprising the steps of:

(a) positioning a sensor at a first end point in a movement direction of said sensor, said sensor being capable of performing a substantially linear movement from said first end point to a second end point and from said second end point back to said first end point;

(b) carrying said recording medium in a predetermined direction up to a detection position which is a position of said recording medium where said sensor detects said recording medium when said sensor is positioned at said first end point, said predetermined direction being a direction intersecting said movement direction of said sensor, and said recording medium having at least a leading edge which is the foremost edge in said predetermined direction;

(c) carrying said recording medium by a predetermined opposite-carrying amount from said detection position in a direction opposite to said predetermined direction, and then moving said sensor toward said second end point; and (d) if said sensor, after said recording medium has been carried in said opposite direction, detects said recording medium while said sensor is being moved toward said second end point, then:

obtaining a corner-to-corner distance which is a distance, in said predetermined direction, between a first corner of said recording medium formed by said leading edge of said recording medium and a first side edge thereof, and a second corner of said recording medium formed by said leading edge of said recording medium and a second side edge thereof based on a movement distance from said first end point to a position at which said sensor detected said recording medium and said predetermined opposite-carrying amount by which said recording medium is carried in said opposite direction; and carrying said recording medium in said predetermined direction by an amount that corresponds to said corner-to-corner distance.

17. A recording method according to claim 16, wherein:

if said sensor, after said recording medium has been carried in said opposite direction, does not detect said recording medium while said sensor is being moved toward said second end point, then said recording medium is simply carried from said detection position by a predetermined amount in said predetermined direction.

18. A recording method according to claim 16, wherein:

if said sensor, after said recording medium has been carried in said opposite direction, detects said recording medium while said sensor is being moved toward said second end point, then:

a skew angle of said recording medium in a direction intersecting said movement direction of said sensor is obtained based on said movement distance from said first end point to the position at which said sensor detected said recording medium and said predetermined opposite-carrying amount; and said corner-to-corner distance is obtained based on said skew angle and a width of said recording medium.

19. A recording method according to claim 16, wherein:

said sensor moves in said movement direction together with a recording head.

20. A recording method according to claim 19, wherein:

said recording head carries out recording with respect to an entire surface of said recording medium.

21. A recording method according to claim 16, wherein:

said sensor comprises a light-emitting member for emitting light and a light-receiving member for receiving light emitted by said light-emitting member, and detects said recording medium based on an output value of said light-receiving member.

22. A recording method for recording on a recording medium, comprising the steps of:

(a) dividing a movement direction of a sensor into a plurality of sectors and positioning said sensor at a first end point in said movement direction, said sensor being capable of performing a substantially linear movement from said first end point to a second end point and from said second end point back to said first end point;

(b) carrying said recording medium in a predetermined direction up to a detection position which is a position of said recording medium where said sensor detects said recording medium when said sensor is positioned at said first end point, said predetermined direction being a direction intersecting said movement direction of said sensor, and said recording medium having at least a leading edge which is the foremost edge in said predetermined direction;

(c) carrying said recording medium by a predetermined opposite-carrying amount from said detection position in a direction opposite to said predetermined direction, and then moving said sensor toward said second end point; and (d) if said sensor, after said recording medium has been carried in said opposite direction, detects said recording medium while said sensor is being moved toward said second end point, then:

obtaining a corner-to-corner distance which is a distance, in said predetermined direction, between a first corner of said recording medium formed by said leading edge of said recording medium and a first side edge thereof, and a second corner of said recording medium formed by said leading edge of said recording medium and a second side edge thereof, according to which sector said sensor detected said recording medium in; and carrying said recording medium in said predetermined direction by an amount that corresponds to said corner-to-corner distance.

23. A recording method according to claim 22, wherein:

if said sensor, after said recording medium has been carried in said opposite direction, does not detect said recording medium while said sensor is being moved toward said second end point, then said recording medium is simply carried from said detection position by a predetermined amount in said predetermined direction.

24. A recording method according to claim 22, wherein:

said sensor moves in said movement direction together with a recording head.

25. A recording method according to claim 24, wherein:

said recording head carries out recording with respect to an entire surface of said recording medium.

26. A recording method according to claim 22, wherein:

said sensor comprises a light-emitting member for emitting light and a light-receiving member for receiving light emitted by said light-emitting member, and detects said recording medium based on an output value of said light-receiving member.

27. A recording apparatus for recording on a recording medium, comprising:

a movable sensor for detecting said recording medium, said sensor being capable of performing a substantially linear movement from a first end point to a second end point and from said second end point back to said first end point;

a carrying mechanism for carrying said recording medium in a predetermined direction intersecting a movement direction of said sensor;

wherein;

(a) said sensor is positioned at said first end point in said movement direction of said sensor;

(b) said carrying mechanism carries said recording medium in said predetermined direction up to a detection position which is a position of said recording medium where said sensor detects said recording medium when said sensor is positioned at said first end point, said recording medium having at least a leading edge which is the foremost edge in said predetermined direction;

(c) said recording medium is carried by a predetermined opposite-carrying amount from said detection position in a direction opposite to said predetermined direction, and then said sensor is moved toward said second end point; and (d) if said sensor, after said recording medium has been carried in said opposite direction, detects said recording medium while said sensor is being moved toward said second end point, then:

a corner-to-corner distance which is a distance, in said predetermined direction, between a first corner of said recording medium formed by said leading edge of said recording medium and a first side edge thereof, and a second corner of said recording medium formed by said leading edge of said recording medium and a second side edge thereof is obtained based on a movement distance from said first end point to a position at which said sensor detected said recording medium and said predetermined opposite-carrying amount by which said recording medium is carried in said opposite direction; and said carrying mechanism carries said recording medium in said predetermined direction by an amount that corresponds to said corner-to-corner distance.

28. A recording apparatus for recording on a recording medium, comprising:

a movable sensor for detecting said recording medium, said sensor being capable of performing a substantially linear movement from a first end point to a second end point and from said second end point back to said first end point;

a carrying mechanism for carrying said recording medium in a predetermined direction intersecting a movement direction of said sensor;

wherein;

(a) said movement direction of said sensor is divided into a plurality of sectors, and said sensor is positioned at said first end point in said movement direction;

(b) said carrying mechanism carries said recording medium in said predetermined direction up to a detection position which is a position of said recording medium where said sensor detects said recording medium when said sensor is positioned at said first end point, said recording medium having at least a leading edge which is the foremost edge in said predetermined direction;

(c) said recording medium is carried by a predetermined opposite-carrying amount from said detection position in a direction opposite to said predetermined direction, and then said sensor is moved toward said second end point; and (d) if said sensor, after said recording medium has been carried in said opposite direction, detects said recording medium while said sensor is being moved toward said second end point, then:

a corner-to-corner distance which is a distance, in said predetermined direction, between a first corner of said recording medium formed by said leading edge of said recording medium and a first side edge thereof, and a second corner of said recording medium formed by said leading edge of said recording medium and a second side edge thereof is obtained, according to which sector said sensor detected said recording medium in; and said carrying mechanism carries said recording medium in said predetermined direction by an amount that corresponds to said corner-to-corner distance.

29. A computer-readable medium for causing a recording apparatus to operate, comprising:

(a) a code for positioning a sensor at a first end point in a movement direction of said sensor, said sensor being capable of performing a substantially linear movement from said first end point to a second end point and from said second end point back to said first end point;

(b) a code for carrying a recording medium in a predetermined direction up to a detection position which is a position of said recording medium where said sensor detects said recording medium when said sensor is positioned at said first end point, said predetermined direction being a direction intersecting said movement direction of said sensor, and said recording medium having at least a leading edge which is the foremost edge in said predetermined direction;

(c) a code for carrying said recording medium by a predetermined opposite-carrying amount from said detection position in a direction opposite to said predetermined direction, and then moving said sensor toward said second end point; and (d) a code for:

obtaining a corner-to-corner distance which is a distance, in said predetermined direction, between a first corner of said recording medium formed by said leading edge of said recording medium and a first side edge thereof, and a second corner of said recording medium formed by said leading edge of said recording medium and a second side edge thereof based on a movement distance from said first end point to a position at which said sensor detected said recording medium and said predetermined opposite-carrying amount by which said recording medium is carried in said opposite direction; and carrying said recording medium in said predetermined direction by an amount that corresponds to said corner-to-corner distance if said sensor, after said recording medium has been carried in said opposite direction, detects said recording medium while said sensor is being moved toward said second end point.

30. A computer-readable medium for causing a recording apparatus to operate, comprising:

(a) a code for dividing a movement direction of a sensor into a plurality of sectors and positioning said sensor at a first end point in said movement direction, said sensor being capable of performing a substantially linear movement from said first end point to a second end point and from said second end point back to said first end point;

(b) a code for carrying a recording medium in a predetermined direction up to a detection position which is a position of said recording medium where said sensor detects said recording medium when said sensor is positioned at said first end point, said predetermined direction being a direction intersecting said movement direction of said sensor, and said recording medium having at least a leading edge which is the foremost edge in said predetermined direction;

(c) a code for carrying said recording medium by a predetermined opposite-carrying amount from said detection position in a direction opposite to said predetermined direction, and then moving said sensor toward said second end point; and (d) a code for:

obtaining a corner-to-corner distance which is a distance, in said predetermined direction, between a first corner of said recording medium formed by said leading edge of said recording medium and a first side edge thereof, and a second corner of said recording medium formed by said leading edge of said recording medium and a second side edge thereof, according to which sector said sensor detected said recording medium in; and carrying said recording medium in said predetermined direction by an amount that corresponds to said corner-to-corner distance if said sensor, after said recording medium has been carried in said opposite direction, detects said recording medium while said sensor is being moved toward said second end point.

* * * * *